US012790155B2

(12) United States Patent
Okuda et al.

(10) Patent No.: US 12,790,155 B2
(45) Date of Patent: Nov. 10, 2026

(54) BAGMAKING-AND-PACKAGING APPARATUS

(71) Applicant: ISHIDA CO., LTD., Kyoto (JP)

(72) Inventors: Shinnosuke Okuda, Ritto (JP); Satoshi Hashimoto, Ritto (JP); Ryota Nagashima, Ritto (JP); Hiroki Fujihara, Ritto (JP); Yuchuan Tong, Ritto (JP); Riku Murakami, Ritto (JP); Masaki Shinkawa, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 118 days.

(21) Appl. No.: 18/938,912

(22) Filed: Nov. 6, 2024

(65) Prior Publication Data

US 2025/0153965 A1 May 15, 2025

(30) Foreign Application Priority Data

Nov. 10, 2023 (JP) ..... 2023-192268
Mar. 18, 2024 (JP) ..... 2024-042004

(51) Int. Cl.
*B65H 19/18* (2006.01)
*B65B 41/16* (2006.01)

(52) U.S. Cl.
CPC ..... *B65H 19/1847* (2013.01); *B65B 41/16* (2013.01); *B65H 19/1873* (2013.01); *B65H 2301/46176* (2013.01); *B65H 2301/4634* (2013.01); *B65H 2601/511* (2013.01); *B65H 2801/81* (2013.01)

(58) Field of Classification Search
None
See application file for complete search history.

(56) References Cited

U.S. PATENT DOCUMENTS 5,318,646 A * 6/1994 Cardini ..... B65H 19/1863 156/507
5,618,377 A * 4/1997 Kaneko ..... B65H 19/1873 242/555.6
2013/0340945 A1 12/2013 Abate
2020/0108958 A1* 4/2020 Shimoda ..... B65B 43/06

FOREIGN PATENT DOCUMENTS

EP 0464003 A1 1/1992
EP 0847948 A2 6/1998
JP 2008001429 A 1/2008

OTHER PUBLICATIONS

Extended European Search Report for EP24211214.2, dated Mar. 26, 2025, 7 pages in total.

* cited by examiner

*Primary Examiner* — Tanzim Imam
(74) *Attorney, Agent, or Firm* — United IP Counselors, LLC

(57) ABSTRACT

In a bagmaking-and-packaging apparatus, when switching from bagmaking using a first film to bagmaking using a second film, a first impulse sealer interconnects an end-of-bagmaking film of the first film and a starting end scrap of the second film to form a first interconnected film. A second impulse sealer interconnects a third part on a starting end side of the first F1 and a fourth part of the second film to form a second interconnected film.

9 Claims, 25 Drawing Sheets

BAGMAKING-AND-PACKAGING APPARATUS

BACKGROUND

Technical Field

The claimed invention relates to a bagmaking-and-packaging apparatus.

Related Art

Conventionally, in relation to bagmaking-and-packaging apparatus that use a film to automatically package articles, technologies are known which shorten the amount of time in which the apparatus is stopped and switch between film rolls by presetting a film roll separate from a film roll currently in use and automatically connect the starting end part of the separate film roll when the film of the film roll has run low. For example, JP-A No. 2008-1429 discloses a packaging apparatus that automatically switches between film rolls.

SUMMARY

Technical Problem

In conventional packaging apparatus such as disclosed in JP-A No. 2008-1429, two films are automatically interconnected, the interconnected part is cut by a cutter, and thereafter bagmaking and packaging using the film paid out from the new film roll is performed.

However, when two films are interconnected and the interconnected part is cut, the starting end part of the new film ends up being left over as a film scrap, and the film scrap needs to be removed by human hands. This is because if the film scrap is not removed, the scrap may get caught in a film conveyance mechanism or entangled in a drive mechanism of the packaging apparatus and obstruct the operation of the packaging apparatus.

It is a goal of embodiment of the claimed invention to inhibit a film scrap from being generated when interconnecting two films in a bagmaking-and-packaging apparatus and reduce the burden on an operator of having to remove the film scrap by hand.

Solution to Problem

A bagmaking-and-packaging apparatus of a first aspect includes a first retention unit, a second retention unit, a conveyance unit, a bagmaking-and-packaging unit, an interconnecting unit, and a cutting unit. The first retention unit retains a first film roll in which a film is wound. The second retention unit retains a second film roll in which a film is wound. The conveyance unit conveys a film in a film conveyance direction. The bagmaking-and-packaging unit makes bags containing articles using the film conveyed by the conveyance unit. The interconnecting unit has a splicing unit. The splicing unit extends in a direction intersecting the film conveyance direction. The interconnecting unit uses the splicing unit to interconnect a first film and a second film in a first position and a second position. The first position and the second position are positions where the first film and the second film overlap each other. The first film is the film pulled out from the first film roll. The second film is the film pulled out from the second film roll. The cutting unit cuts the first film and the second film in a position between the first position and the second position. In the bagmaking-and-packaging apparatus, when switching from bagmaking using the first film to bagmaking using the second film, the splicing unit forms a first interconnected film and forms a second interconnected film. Specifically, the splicing unit interconnects a first part on the first retention unit side of the first film and a second part on a starting end side of the second film to form a first interconnected film that is a film in which the first part and the second part are interconnected. The splicing unit interconnects a third part on a starting end side of the first film and a fourth part on the second retention unit side of the second film to form a second interconnected film that is a film in which the third part and the fourth part are interconnected.

Here, when switching from bagmaking using the first film to bagmaking using the second film, the splicing unit forms the second interconnected film that becomes used for bagmaking and packaging and connects the second part on the starting end side of the second film to the first part on the first retention unit side of the first film to form the first interconnected film. For this reason, the second part on the starting end side of the second film is connected to the first part on the first retention unit side of the first film without becoming a film scrap. Because of this, in the bagmaking-and-packaging apparatus of the first aspect, the second part on the starting end side of the second film is inhibited from becoming a film scrap, and the burden on the operator of having to remove the film scrap by hand is reduced.

It will be noted that the cutting of the first film and the second film by the cutting unit may be performed before the first film and the second film are interconnected or may be performed after the first film and the second film are interconnected.

A bagmaking-and-packaging apparatus of a second aspect is the bagmaking-and-packaging apparatus of the first aspect, wherein the splicing unit has a first sealing unit and a second sealing unit. The first sealing unit and the second sealing unit extend in a direction intersecting the film conveyance direction. The first sealing unit and the second sealing unit are disposed a predetermined distance apart from each other in the film conveyance direction. The first sealing unit interconnects the first film and the second film in the first position. The second sealing unit interconnects the first film and the second film in the second position. When switching from bagmaking using the first film to bagmaking using the second film, the first sealing unit interconnects the first part and the second part to form the first interconnected film and the second sealing unit interconnects the third part and the fourth part to form the second interconnected film.

A bagmaking-and-packaging apparatus of a third aspect is the bagmaking-and-packaging apparatus of the first aspect or the second aspect, wherein the cutting unit cuts the first film between the first part and the third part and the second film between the second part and the fourth part.

A bagmaking-and-packaging apparatus of a fourth aspect is the bagmaking-and-packaging apparatus of the third aspect, wherein the apparatus switches from bagmaking using the first film to bagmaking using the second interconnected film and furthermore switches from bagmaking using the second interconnected film to bagmaking using the second film after the formation of the first interconnected film, the formation of the second interconnected film, and the cutting of the first film and the second film.

A bagmaking-and-packaging apparatus of a fifth aspect is the bagmaking-and-packaging apparatus of any of the first aspect to the fourth aspect, further including a control unit that controls the interconnecting unit. The splicing unit heat-seals the first film and the second film. The control unit changes the duration of the heat-sealing of the first film and the second film depending on whether contact surfaces of the first film and the second film that overlap each other are front sides of the films or back sides of the films.

A bagmaking-and-packaging apparatus of a sixth aspect is the bagmaking-and-packaging apparatus of any of the first aspect to the fifth aspect, further including a moving unit that moves the interconnecting unit. The moving unit moves the interconnecting unit when switching from bagmaking using the first film to bagmaking using the second film.

A bagmaking-and-packaging apparatus of a seventh aspect is the bagmaking-and-packaging apparatus of the sixth aspect, further including a control unit that controls the moving unit. The control unit controls the moving unit so that the position of the interconnecting unit when switching from bagmaking using the first film to bagmaking using the second film and the position of the interconnecting unit when switching from bagmaking using the second film to bagmaking using the first film are different.

A bagmaking-and-packaging apparatus of an eighth aspect is the bagmaking-and-packaging apparatus of the first aspect, wherein the conveyance unit conveys the first film and the second film after the interconnection of the first film and the second film by the splicing unit in the first position and before the interconnection of the first film and the second film by the splicing unit in the second position.

A bagmaking-and-packaging apparatus of a ninth aspect is the bagmaking-and-packaging apparatus of the eighth aspect, wherein the cutting unit cuts the first film and the second film in a position between the first position and the second position after the interconnection of the first film and the second film by the splicing unit in the second position.

A bagmaking-and-packaging apparatus of a tenth aspect is the bagmaking-and-packaging apparatus of the ninth aspect, wherein the conveyance unit conveys the first film and the second film to match the position of the cutting of the first film and the second film by the cutting unit after the interconnection of the first film and the second film by the splicing unit in the second position and before the cutting of the first film and the second film by the cutting unit.

Advantageous Effects of the Invention

According to the bagmaking-and-packaging apparatus pertaining to the claimed invention, the second part on the starting end side of the second film is connected to the first part on the first retention unit side of the first film without becoming a film scrap. Because of this, in the bagmaking-and-packaging apparatus of the claimed invention, the second part on the starting end side of the second film is inhibited from becoming a film scrap, and the burden on the operator of having to remove the film scrap by hand is reduced.

DETAILED DESCRIPTION

An embodiment of the claimed invention will be described below with reference to the drawings. It will be noted that the following embodiment is one specific example of the claimed invention and is not intended to limit the technical scope of the claimed invention.

(1) OVERVIEW OF WEIGHING, BAGMAKING, AND PACKAGING SYSTEM

An embodiment 102 of a bagmaking-and-packaging apparatus in accordance with the claimed invention and a weighing, bagmaking, and packaging system 100 including the bagmaking-and-packaging apparatus 102 will be described below with reference to the drawings.

Figure 1:
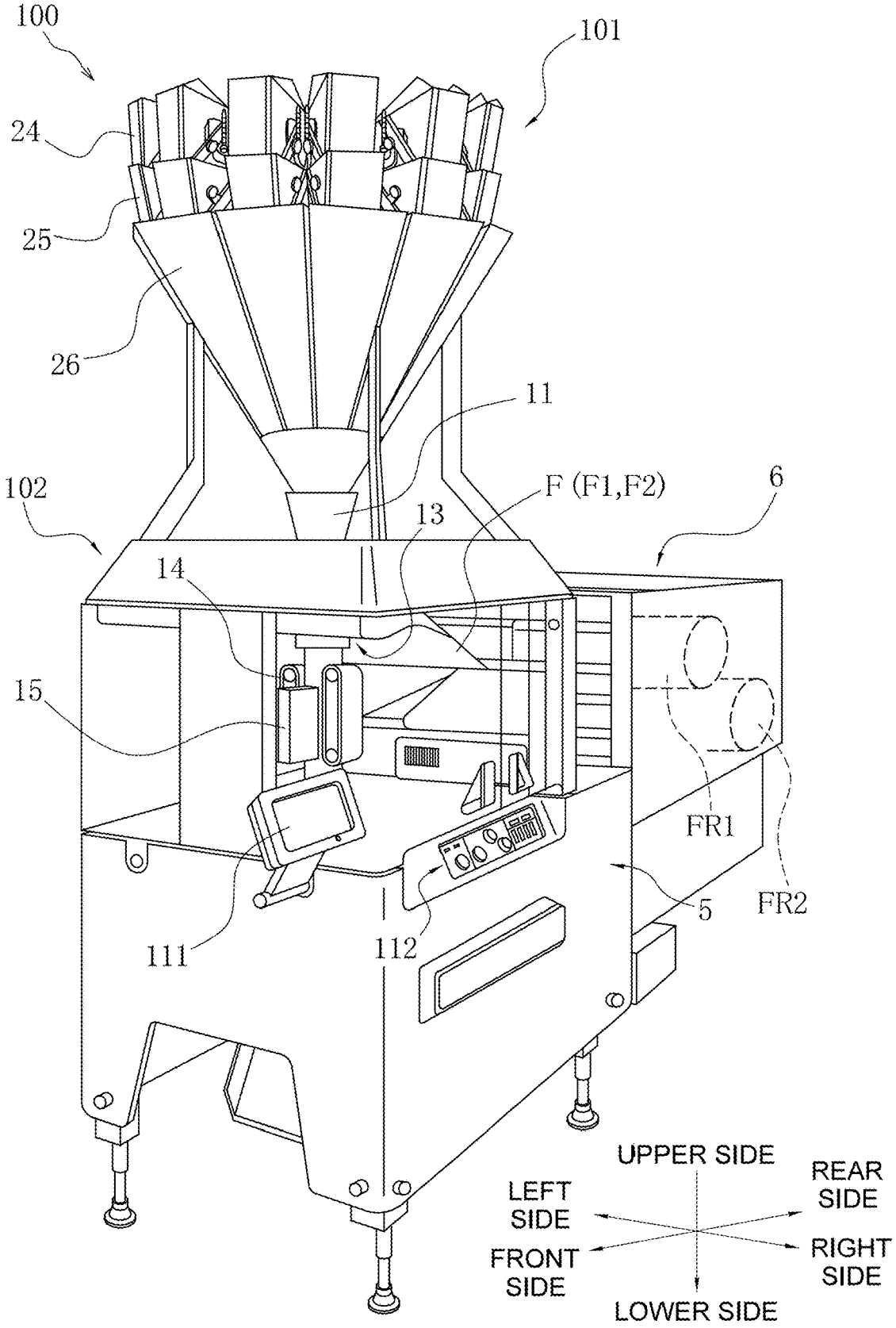
FIG. 1 is a perspective view, seen from the front right side, of a weighing, bagmaking, and packaging system including a bagmaking-and-packaging apparatus in accordance with the claimed invention.

FIG. 1 shows an external perspective view of the weighing, bagmaking, and packaging system 100. The weighing, bagmaking, and packaging system 100 is a system including a weighing apparatus 101 and the bagmaking-and-packaging apparatus 102. The weighing, bagmaking, and packaging system 100 has a configuration where the bagmaking-and-packaging apparatus 102 is disposed on bottom and the weighing apparatus 101 is disposed on top, and a touch panel 111 and operation switches 112 with which the bagmaking-and-packaging apparatus 102 and the weighing apparatus 101 can be integrally operated are provided on the right side.

The weighing apparatus 101 may be a combination weigher with a known configuration. Articles that are the object of packaging by the bagmaking-and-packaging apparatus 102 may be a snack food such as potato chips, for example, and they are supplied to the central upper portion of the weighing apparatus 101. The articles supplied to the central upper portion are dispersed to plural radial paths and are thereafter supplied via plural pool hoppers 24 disposed on terminal ends of the paths to corresponding weigh hoppers 25 below. The weights of the articles weighed by the weigh hoppers 25 are combined, and an optimum combination of the weigh hoppers 25 forming a fixed weight of the articles is selected. The selected weigh hoppers 25 discharge the articles to a collection chute 26 based on a discharge request signal from the bagmaking-and-packaging apparatus 102. The discharged articles form long columns while falling down the collection chute 26, pass through a funnel member 11 of the bagmaking-and-packaging apparatus 102, and fall to the inside space of a tube 12. The group of articles fall through the inside space of the tube 12 as packaging articles C. The bagmaking-and-packaging apparatus 102 performs bagmaking by putting the packaging articles C inside a tubular film TF and transversely sealing the lower end portion of the tubular film TF and the upper end portion of a preceding bag B at the same time (see FIG. 2).

(2) OVERALL CONFIGURATION OF BAGMAKING-AND-PACKAGING APPARATUS

Figure 5A:
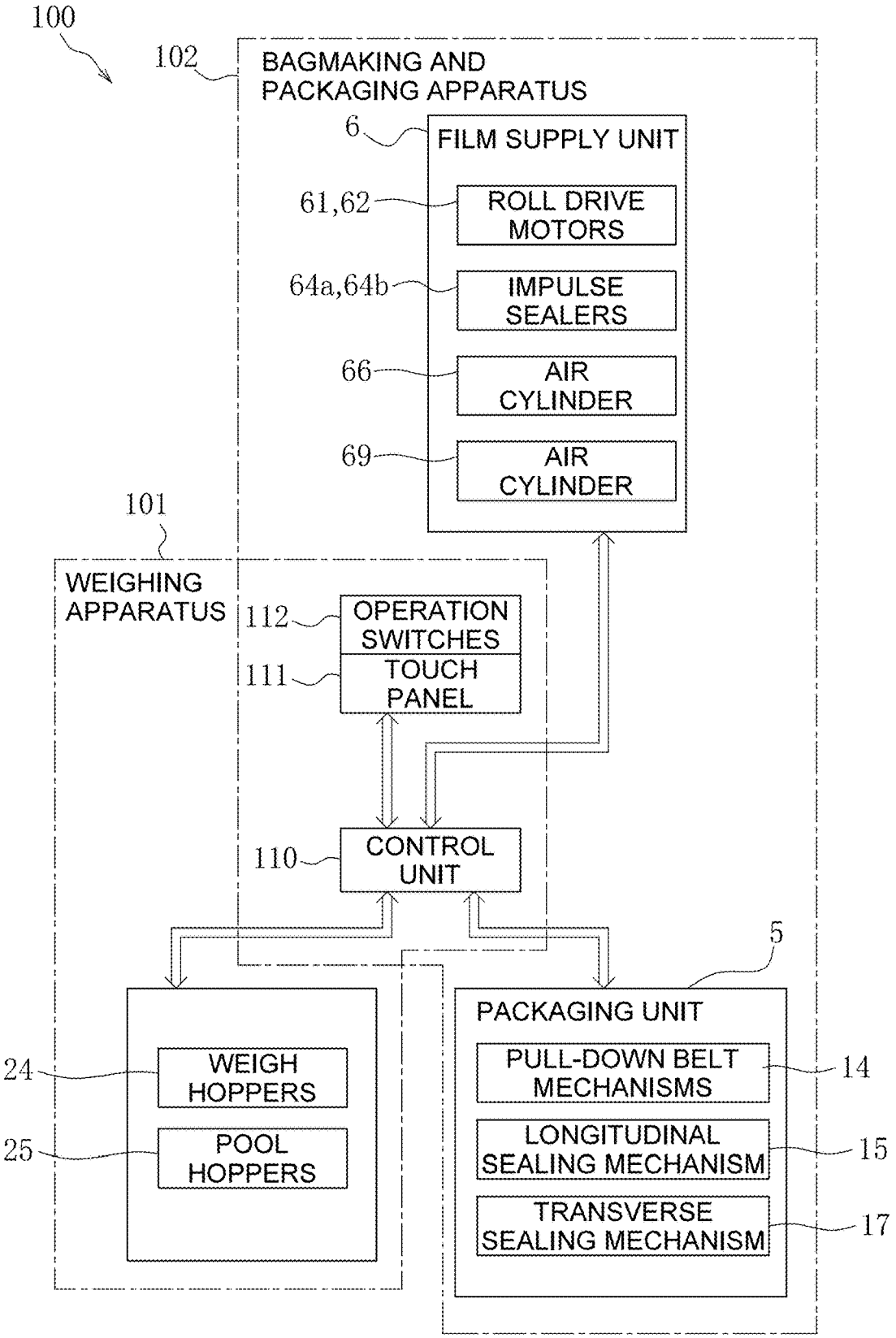
FIG. 5A is a control block diagram of the weighing, bagmaking, and packaging system.

The bagmaking-and-packaging apparatus 102 is configured by a packaging unit 5 that packs the packaging articles C that are articles in bags to make products, a film-supply unit 6 that supplies a film F to the packaging unit 5, and a control unit 110 (see FIG. 5A) that controls operations of drive units of the units 5, 6. The film-supply unit 6 is a unit that supplies the sheet-like film F to a forming mechanism 13 of the packaging unit 5, and is provided adjacent to the rear side of the packaging unit 5.

It will be noted that the film F is a film F1 paid out from a first film roll FR1 described later or a film F2 paid out from a second film roll FR2. When it is not necessary to distinguish between these, they will simply be called the film F.

(2-1) Packaging Unit

Figure 2:
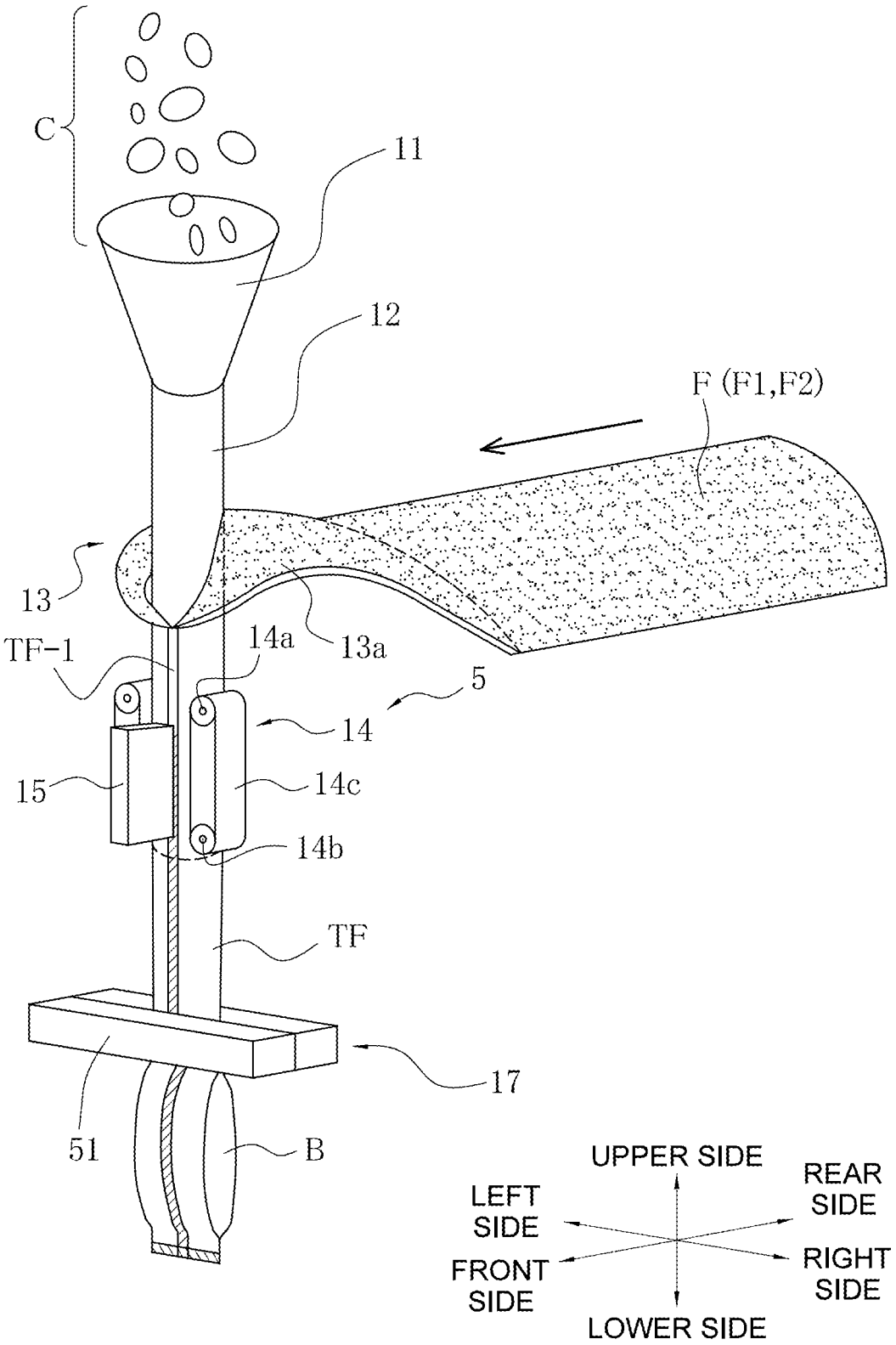
FIG. 2 is a schematic perspective view showing main configurations of a bagmaking-and-packaging unit of the bagmaking-and-packaging apparatus.

The packaging unit 5 is a unit that makes bags B containing the packaging articles C. As shown in FIG. 2, the packaging unit 5 includes a forming mechanism 13 that forms the sheet-like film F into the tubular film TF, pull-down belt mechanisms 14 that convey downward the film formed in the tubular shape (the tubular film TF), a longitudinal sealing mechanism 15 that longitudinally seals, on the front side, an overlapping portion TF-1 where both edges of the tubular film TF overlap, and a transverse sealing mechanism 17. The transverse sealing mechanism 17 transversely seals the bags B formed by the tubular film TF and heat-seals the upper end portion of a bag B and the lower end portion of a trailing bag (the tubular film TF) at the same time. Furthermore, the packaging unit 5 has a tube 12 that guides the packaging articles C into the tubular film TF while the tubular film F becomes wrapped around the outer periphery thereof.

The forming mechanism 13 comprises the tube 12 and a former 13*a* disposed surrounding the lower portion of the tube 12. The sheet-like film F, which is paid out from the film roll FR1 or FR2 retained in the film-supply unit 6, becomes formed in a tubular shape when it passes through a gap between the former 13*a* and the tube 12, with the top surface of the film F becoming the inner peripheral surface of the tubular film TF and the bottom surface of the film F becoming the outer peripheral surface of the tubular film TF.

The pull-down belt mechanisms 14, which have a pair of belts 14*c* disposed on both left and right sides of the tube 12, are mechanisms that suck hold of and convey downward the tubular film TF wrapped around the tube 12. The pull-down belt mechanisms 14, together with the film-supply unit 6, function as a conveyance unit that conveys the film F.

The longitudinal sealing mechanism 15 applies heat to and seals, while pressing with a fixed pressure against the tube 12, the overlapping portion TF-1 where both edges of the tubular film TF overlap. The longitudinal sealing mechanism 15 is configured by a heater block and a metal belt that travels, synchronously with the tubular film TF, around the heater block.

The transverse sealing mechanism 17 transversely seals the tubular film TF, in a state in which the packaging articles C have fallen through the tube 12 into the tubular film TF, to form the bags B filled with the packaging articles C. The transverse sealing mechanism 17 is configured by a pair of sealing jaws 51, which have built-in heaters, and drive mechanisms (not shown in the drawings), which move the pair of sealing jaws 51 toward and away from each other relative to the tubular film TF.

(2-2) Film-Supply Unit

As shown in FIG. 3, FIG. 4, FIG. 5A, and FIG. 6, the film-supply unit 6 mainly includes a first retention unit 81, a second retention unit 82, plural rollers 91*a*, 91*b*, 91*c*, 92*a*, 92*b*, 92*c*, 93*a* to 93*o*, roll drive motors 61, 62, and a film-switching unit 63.

(2-2-1) First Retention Unit and Second Retention Unit

The first retention unit 81 is an air chuck that retains a first film roll FR1 in which a first film F1 is wound. The second retention unit 82 is an air chuck that retains a second film roll FR2 in which a second film F2 is wound. The first retention unit 81 and the second retention unit 82 are rotated by the roll drive motors 61, 62, respectively.

Figure 3:
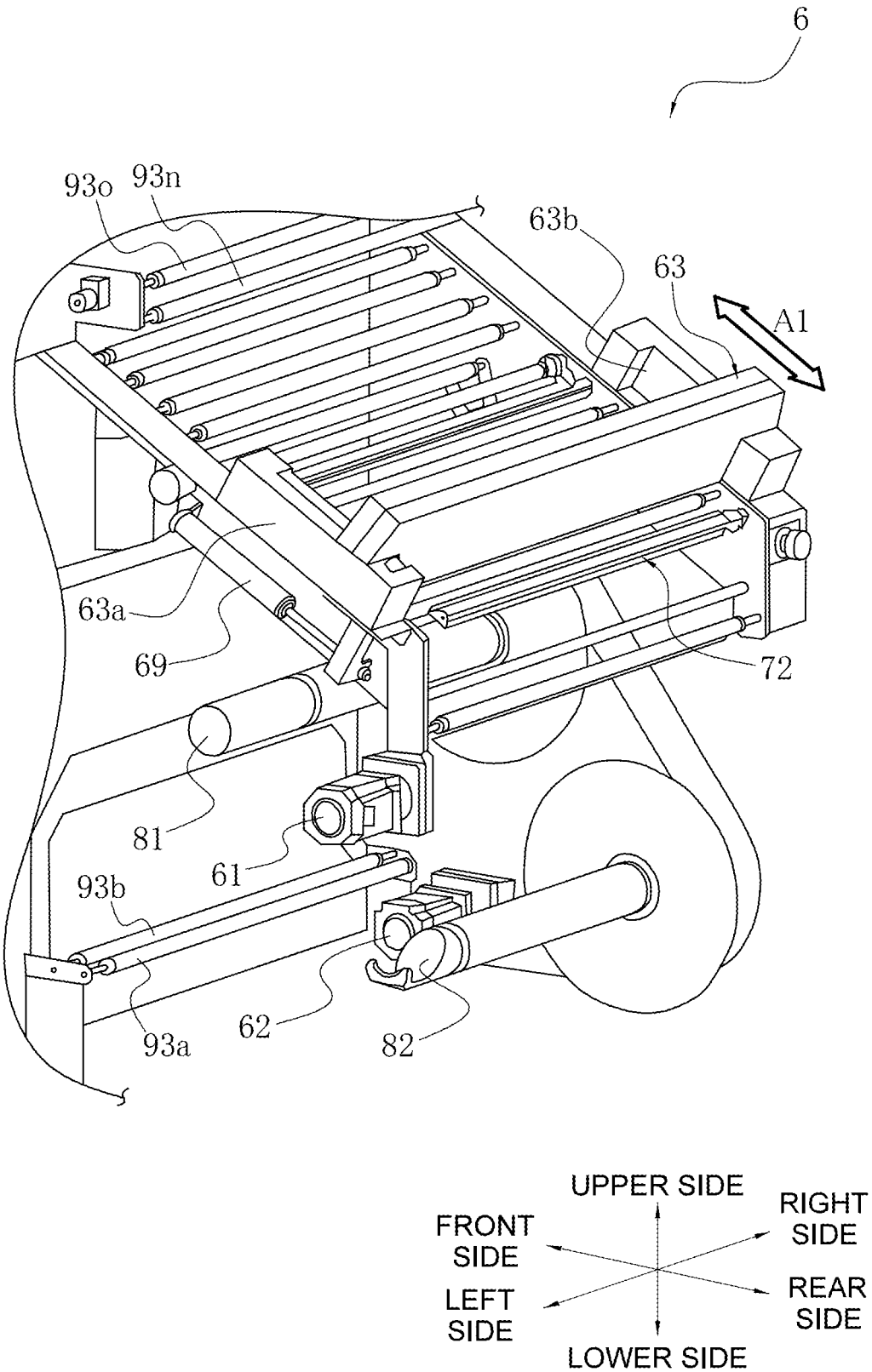
FIG. 3 is a perspective view, seen from the rear side, of a film-supply unit of the bagmaking-and-packaging apparatus.
Figure 4:
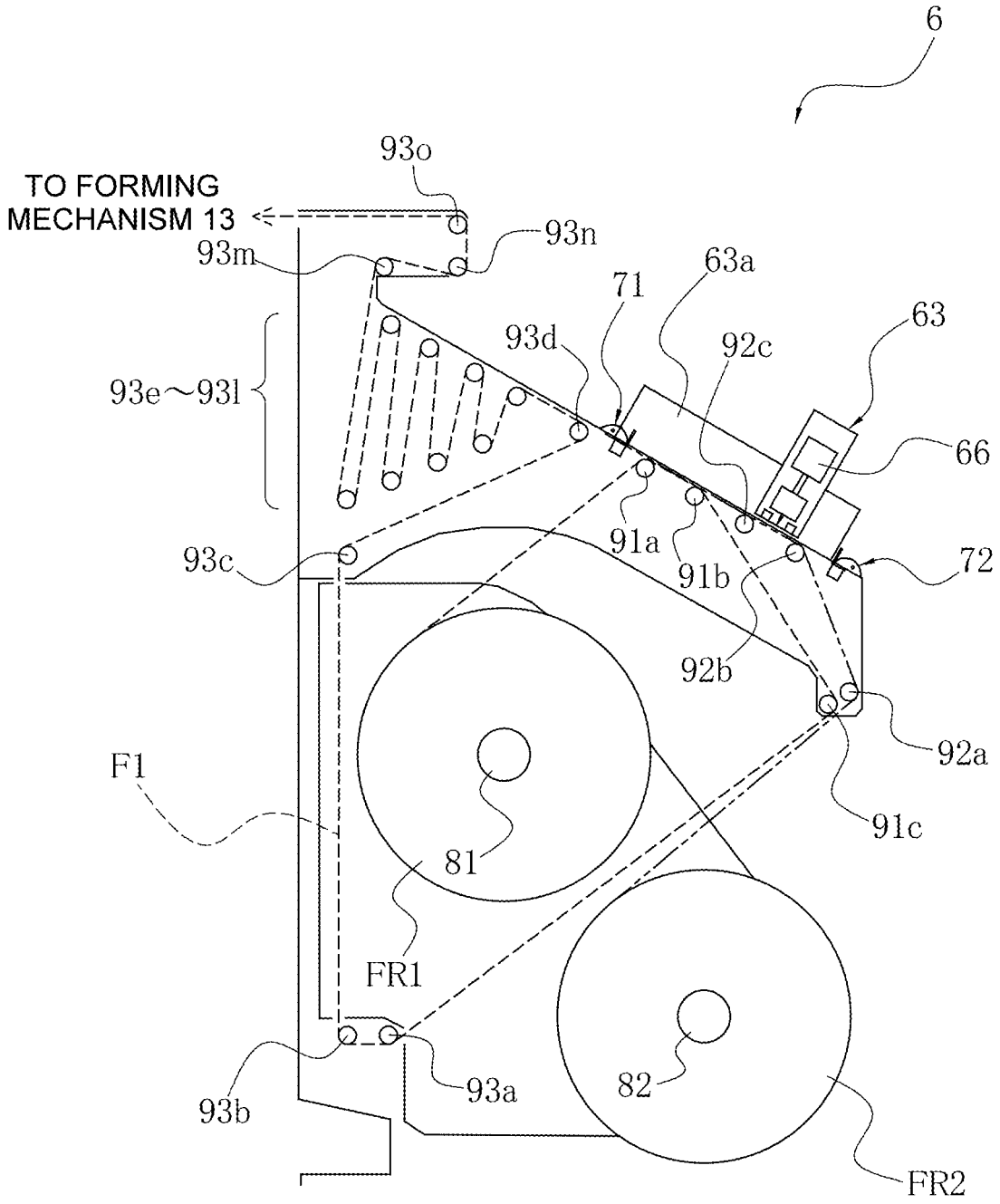
FIG. 4 is a schematic diagram showing a film moving path in which the film-supply unit is seen from the right side.

It will be noted that as shown in FIG. 3 the distal end of the second retention unit 82 has a guide such as shown in FIG. 3 to facilitate setting of the second film roll FR2 (insertion onto the second retention unit 82) from the rear. In contrast, the distal end of the first retention unit 81, which is positioned more forward than the second retention unit 82, has no guide with a shape such as the one on the distal end of the second retention unit 82. Instead, the distal end of the first retention unit 81 extends longer leftward than the distal end of the second retention unit 82. For this reason, the first film roll FR1 can be inserted from the left side onto the first retention unit 81. Furthermore, the distal end of the first retention unit 81 is rounded, so it is easy to insert the first film roll FR1 onto it, and it is also less likely for the first film roll FR1 at the time of insertion to interfere with the second film F2.

(2-2-2) Rollers

Figure 6:
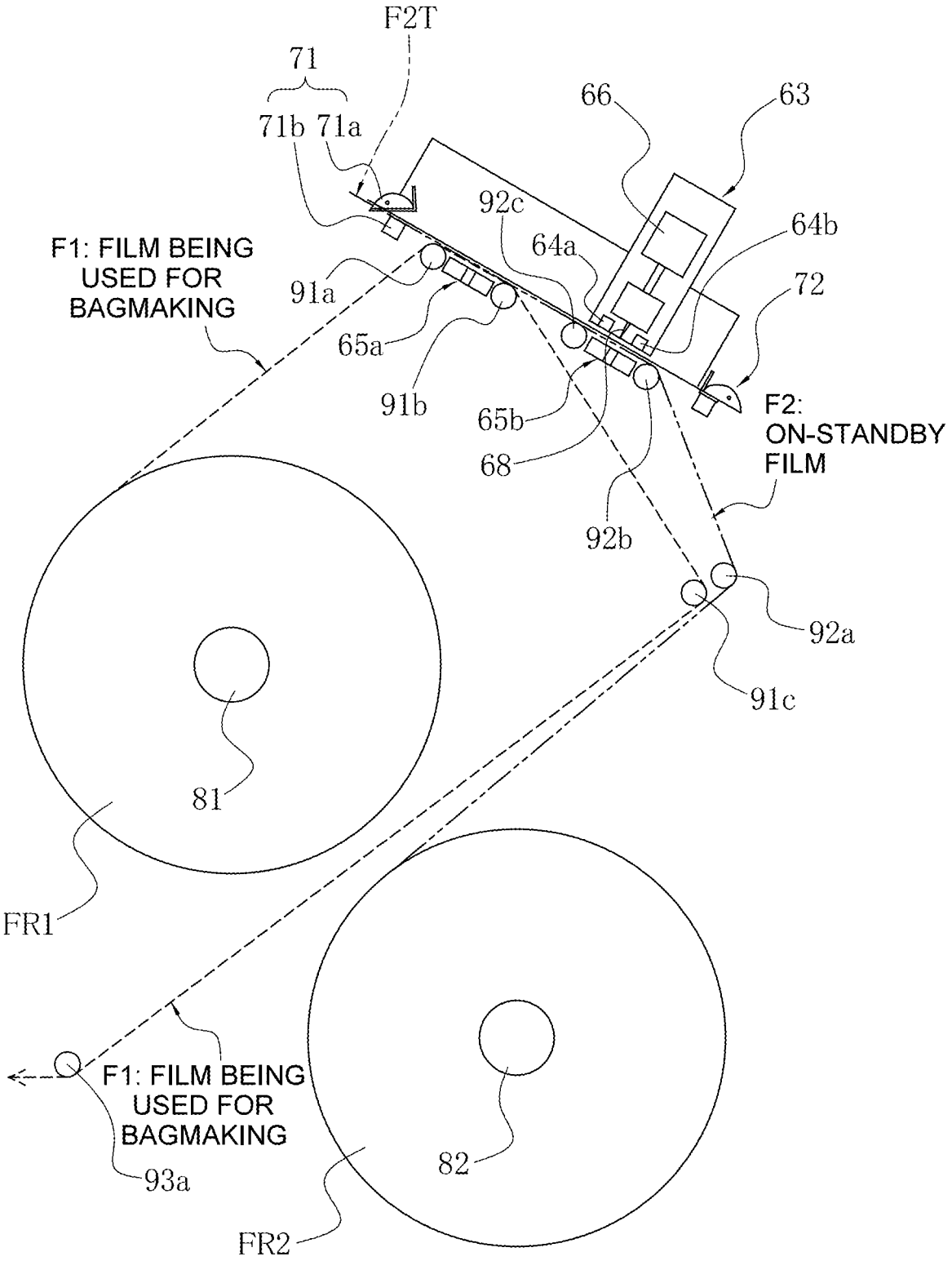
FIG. 6 is a schematic diagram showing a state of the film-supply unit before connecting a second film.
Figure 13:
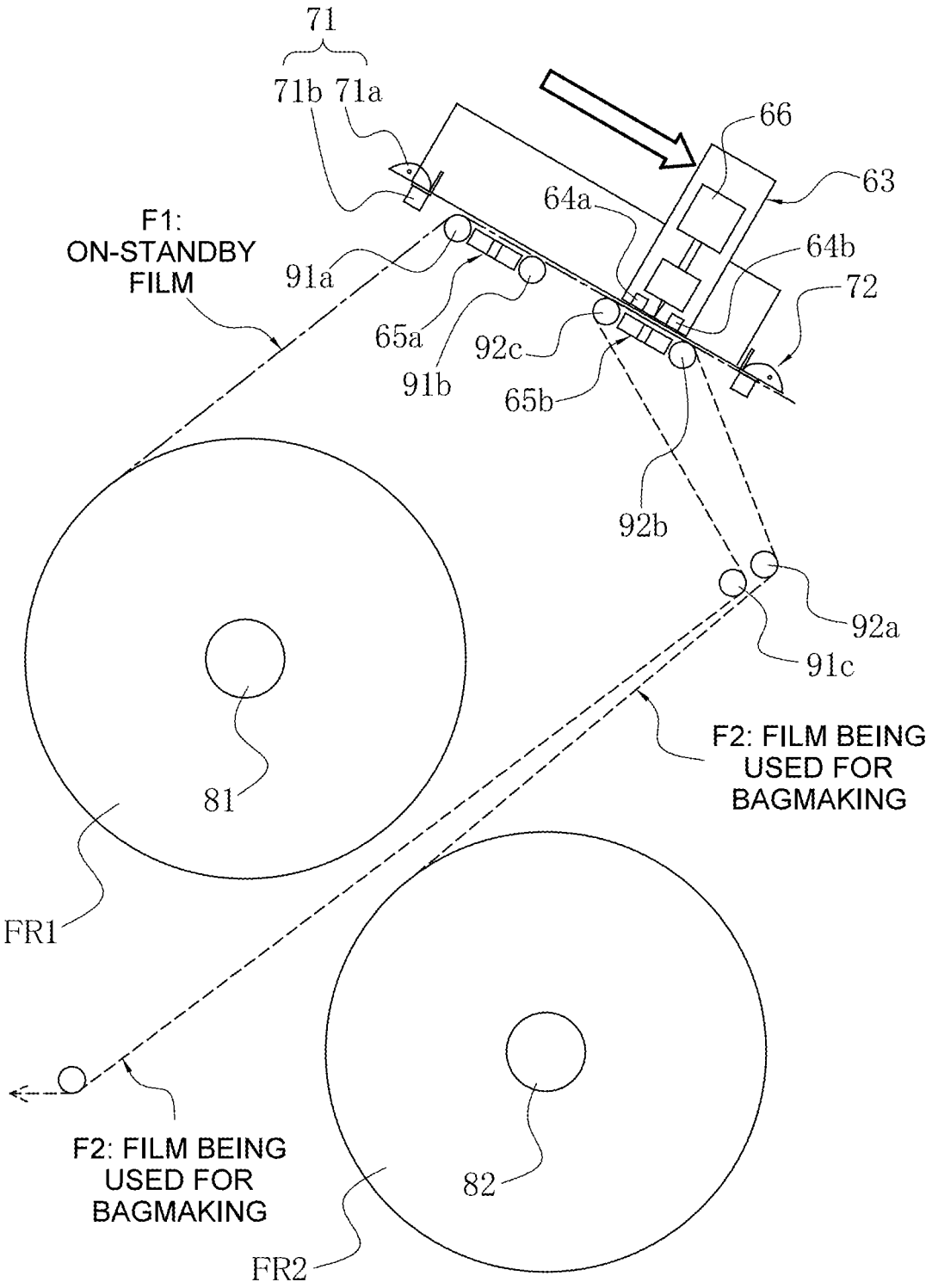
FIG. 13 is a schematic diagram showing a state of the film-supply unit before connecting a first film.
Figure 14:
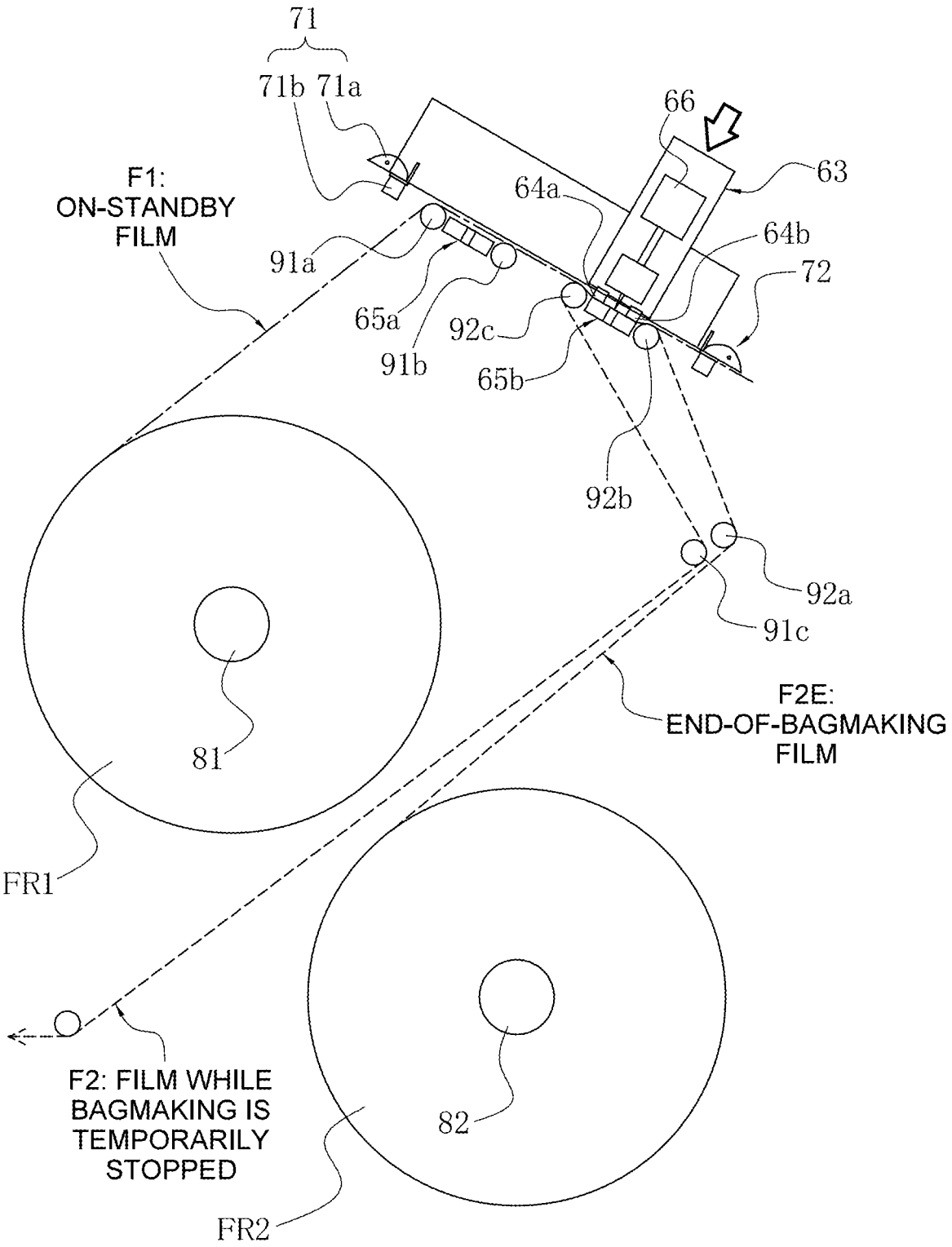
FIG. 14 is a schematic diagram showing a state of the film-supply unit when connecting the first film.

The rollers 91*a*, 91*b*, 91*c*, 92*a*, 92*b*, 92*c*, 93*a* to 93*o* guide the film F paid out from either film roll FR1 (FR2) and, together with the roll drive motors 61, 62 and the pull-down belt mechanisms 14, function as a conveyance unit that conveys the film F. As shown in FIG. 6, the first film F1 paid out from the first film roll FR1 is guided by the rollers 91*a*, 91*b*, 91*c* and is further guided by the rollers from the roller 93*a* on. As shown in FIG. 13, the second film F2 paid out from the second film roll FR2 is guided by the rollers 92*a*, 92*b*, 92*c* and is further guided by the rollers from the roller 93*a* on.

(2-2-3) Film-Switching Unit

The film-switching unit 63 has a first impulse sealer 64*a* and a second impulse sealer 64*b*, a cutter 68, and an air cylinder 66 that are housed inside a case. Both impulse sealers 64*a*, 64*b* extend in a direction intersecting a film conveyance direction A2 shown in FIG. 8B. Specifically, both impulse sealers 64*a*, 64*b* extend in the left and right direction. Furthermore, the first impulse sealer 64*a* and the second impulse sealer 64*b* are disposed a predetermined distance apart from each other in the film conveyance direction A2. The cutter 68 is positioned between the first impulse sealer 64*a* and the second impulse sealer 64*b* in the film conveyance direction A2. Both impulse sealers 64*a*, 64*b* and the cutter 68 are integrated and are together moved by the air cylinder 66. Furthermore, the film-switching unit 63 is supported by a left and right pair of support bases 63*a*, 63*b*, and as shown in FIG. 3 is moved in a front and rear direction A1 by an air cylinder 69 different from the air cylinder 66. Specifically, movement of the film-switching unit 63 from a rear end position shown in FIG. 6 to a front end position shown in FIG. 7 and movement of the film-switching unit 63 from the front end position to the rear end position are done by control of the air cylinder 69 by the control unit 110.

Figure 7:
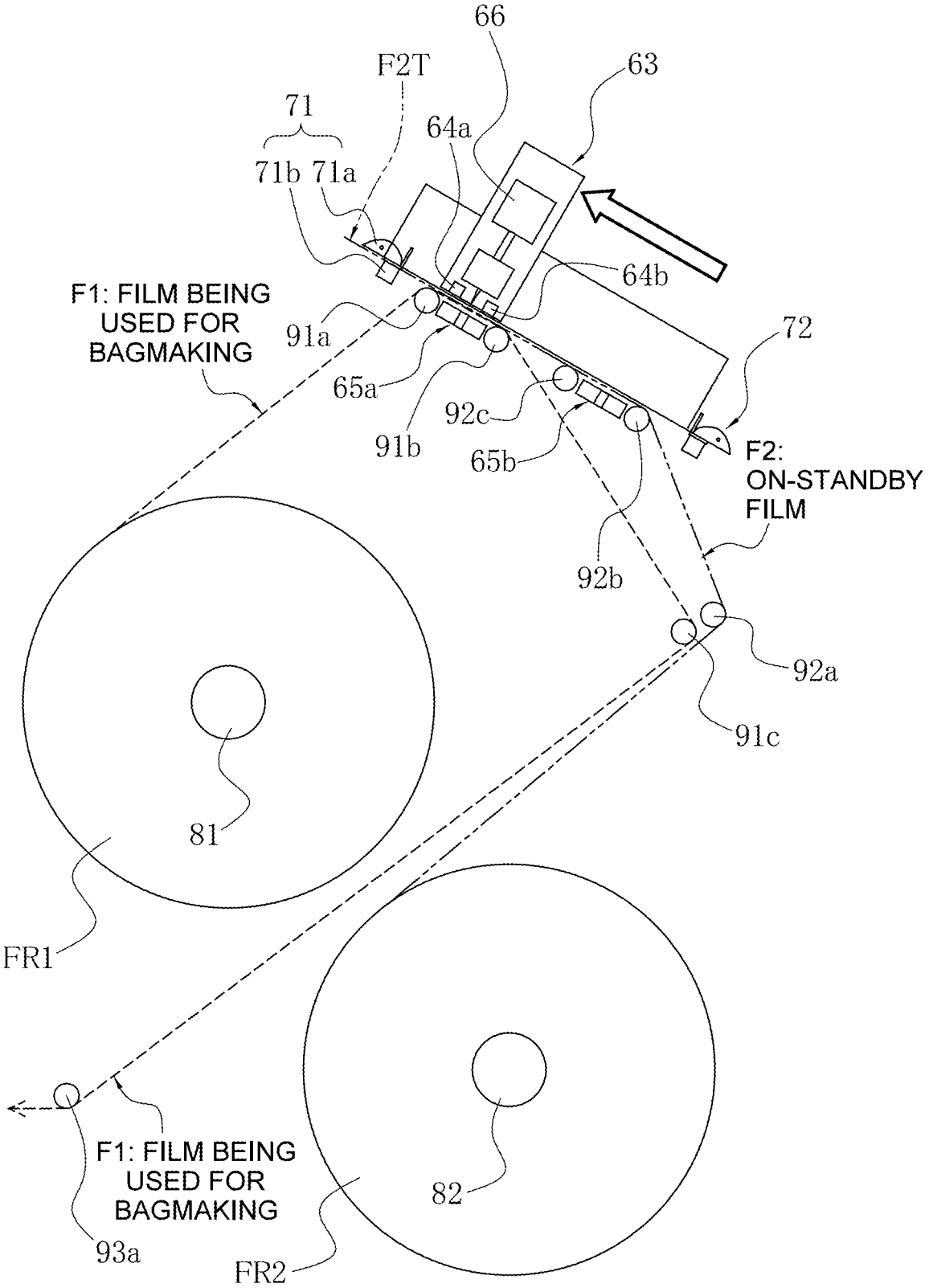
FIG. 7 is a schematic diagram showing a state of the film-supply unit before connecting the second film.

Furthermore, the film-supply unit 6 includes a seal table 65*a*, which opposes both impulse sealers 64*a*, 64*b* of the film-switching unit 63 in the front end position across the film conveyance path, and a seal table 65*b*, which opposes the impulse sealers 64*a*, 64*b* of the film-switching unit 63 in the rear end position across the film conveyance path (see FIG. 6 and FIG. 7). The seal table 65*a* is positioned between the rollers 91*a*, 91*b*. The seal table 65*b* is positioned between the rollers 92*b*, 92*c*. The seal tables 65*a*, 65*b* have the same configurations, so here the seal table 65*a* will be taken as an example and described. As shown in FIG. 8B, the seal table 65*a* is divided into a first portion 65*a*1 that opposes the first impulse sealer 64*a* in the front end position and a second portion 65*a*2 that opposes the second impulse sealer 64*b* in the front end position. The space between the first portion 65*a*1 and the second portion 65*a*2 of the seal table 65*a* is a space into and from which the distal end of the cutter 68 enters and exits. The film-switching unit 63 interconnects and cuts the first film F1 and the second film F2 that vertically overlap each other on the film conveyance path. When there is an instruction to perform the interconnection and cutting from the control unit 110, the air cylinder 66 operates and the cutter 68 and both impulse sealers 64*a*, 64*b* move toward the seal table 65*a*.

Figure 8A:
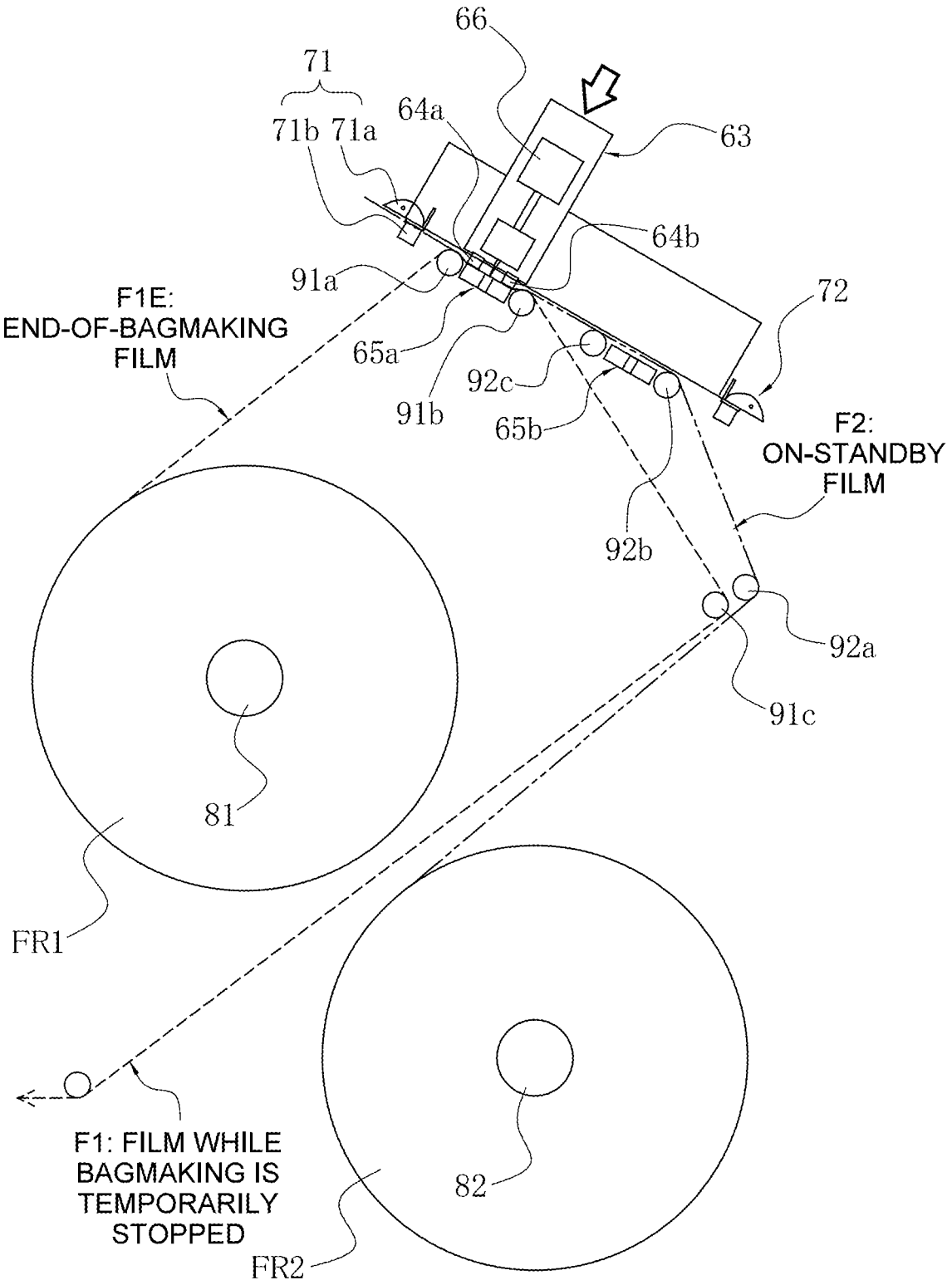
FIG. 8A is a schematic diagram showing a state of the film-supply unit when connecting the second film.
Figure 8B:
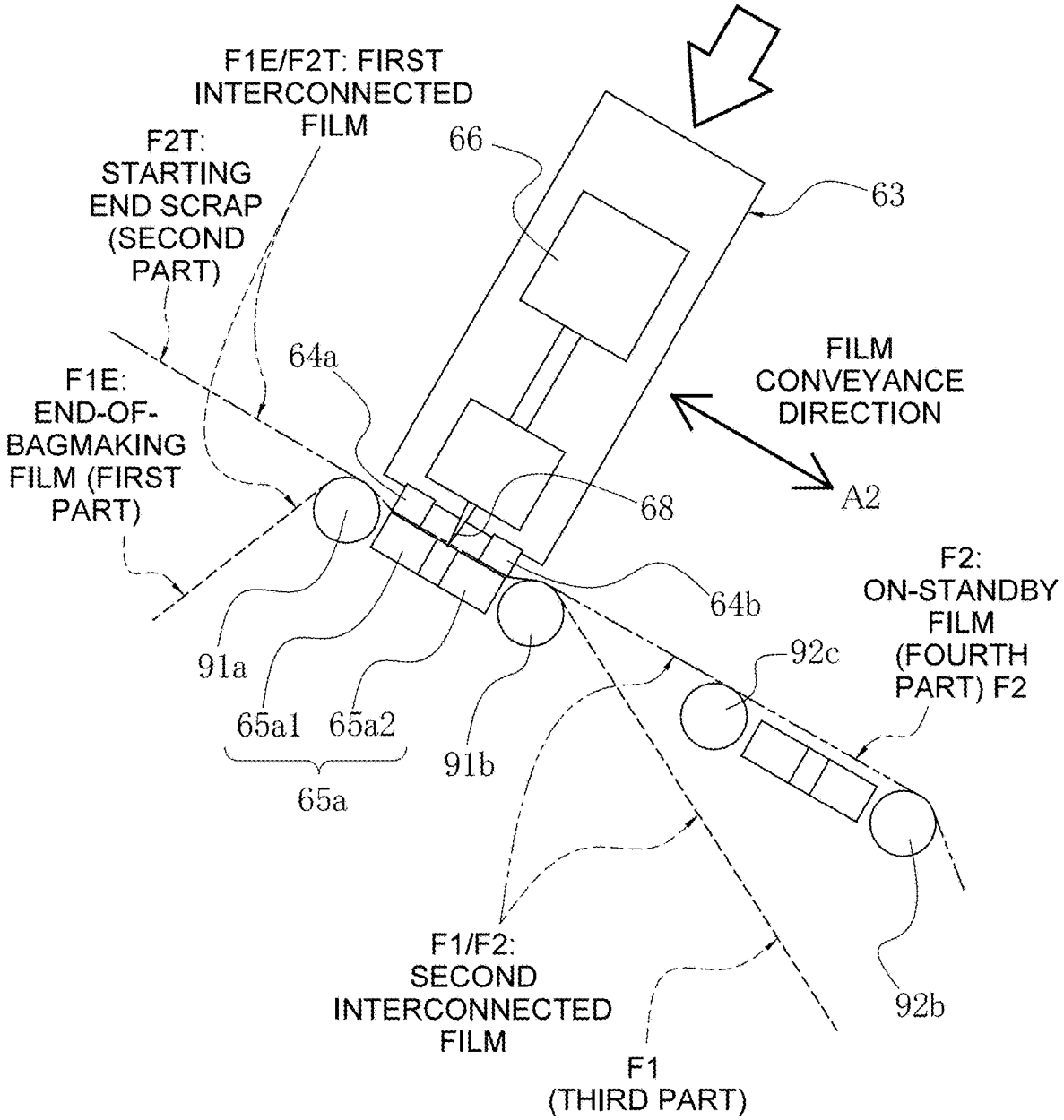
FIG. 8B is a partially enlarged view of FIG. 8A.

As shown in FIG. 8A, when the control unit 110 issues an instruction to extend to the air cylinder 66 of the film-switching unit 63 in a state in which the cutter 68 and the impulse sealers 64*a*, 64*b* are in positions opposing the seal table 65*a*, the cutter 68 and the impulse sealers 64*a*, 64*b* push the first film F1 and the second film F2, which are stopped in a state in which they overlap each other between the roller 91*a* and the roller 91*b*, against the seal table 65*a*. At this time, the first film F1 and the second film F2 are cut in a position between the roller 91*a* and the roller 91*b*, and immediately thereafter the first film F1 and the second film F2 are pinched between the impulse sealers 64*a*, 64*b* and the seal table 65*a* and heat-sealed. Specifically, the first film F1 and the second film F2 are heat-sealed and interconnected in a first position between the first impulse sealer 64*a* and the first portion 65*a*1 shown in FIG. 8B, and the first film F1 and the second film F2 are heat-sealed and interconnected in a second position between the second impulse sealer 64*b* and the second portion 65*a*2. The cutter 68 cuts the first film F1 and the second film F2 in a position between the first position and the second position. Here, although the cutting is performed first and the heat-sealing is performed thereafter, the cutting and the heat-sealing may be performed at the same time, or the cutting may be performed after the heat-sealing.

This cutting and heat-sealing (interconnection) of the overlapping portion of the first film F1 and the second film F2 by the cutter 68 and both impulse sealers 64*a*, 64*b* of the film-switching unit 63 is, as described later, performed when switching from bagmaking and packaging using the first film F1 to bagmaking and packaging using the second film F2. Because of this cutting and heat-sealing, as shown in FIG. 8B, the first impulse sealer 64*a* forms a first interconnected film F1E/F2T and the second impulse sealer 64*b* forms a second interconnected film F1/F2. Specifically, the first impulse sealer 64*a* interconnects a first part (an end-of-bagmaking film F1E) on the first retention unit 81 side of the first film F1 and a second part (a starting end scrap F2T) on the starting end side of the second film F2 to form a first interconnected film F1E/F2T that is a film in which the first part and the second part are interconnected. The second impulse sealer 64*b* interconnects a third part on the starting end side of the first film F1 and a fourth part on the second retention unit 82 side of the second film F2 to form a second interconnected film F1/F2 that is a film in which the third part and the fourth part are interconnected. The first film F1 is cut between the first part and the third part by the cutter 68, and the second film F2 is also cut between the second part and the fourth part by the cutter 68, so the first interconnected film F1E/F2T and the second interconnected film F1/F2 become separate films.

The film-switching unit 63 further includes a first gripping unit 71, which restrains the starting end of the second film F2, and a second gripping unit 72, which restrains the starting end of the first film F1. The first gripping unit 71 and the second gripping unit 72 have the same structures, so here the first gripping unit 71 will be described. The first gripping unit 71 has a restraining member 71*a*, which includes an L-shaped member extending in the left and right direction, and a base 71*b*, which extends in the left and right direction. The restraining member 71*a* is manually switchable between a state in which it is away from the base 71*b* (see FIG. 6) and a state in which it is pressed by gravity against the base 71*b* and is close to the base 71*b* (see FIG. 7). An operator lifts up the restraining member 71*a* so that it is in the state shown in FIG. 6, passes the starting end F2T of the second film F2 between the restraining member 71*a* and the base 71*b*, and lowers the restraining member 71*a*. By so doing, the starting end F2T of the second film F2 becomes gripped by the first gripping unit 71 as shown in FIG. 7.

(2-3) Control Unit

The control unit 110 individually or integrally controls the weighing apparatus 101 and the bagmaking-and-packaging apparatus 102 and is implemented as a computer. The control unit 110 includes a control arithmetic unit and a storage unit. For the control arithmetic unit, a processor such as a CPU or a GPU can be used. The control arithmetic unit reads programs stored in the storage unit and performs predetermined image processing and arithmetic processing in accordance with the programs. Moreover, the control arithmetic unit can write arithmetic results in the storage unit and read information stored in the storage unit in accordance with the programs.

The control unit 110 controls the drive units of the packaging unit 5 and the film-supply unit 6 in accordance with parameters set using the touch panel 111 or the like and operating conditions. The control unit 110 also controls feeders, the pool hoppers 24, and the weigh hoppers 25 of the weighing apparatus 101. Specifically, the control unit 110 imports necessary information from various sensors installed in the weighing apparatus 101 and the bagmaking-and-packaging apparatus 102 and performs various types of control based on that information.

(4) SWITCHING BETWEEN FILMS IN BAGMAKING-AND-PACKAGING APPARATUS

Semiautomatic switching from bagmaking and packaging using the first film F1 of the first film roll FR1 to bagmaking and packaging using the second film F2 of the second film roll FR2 and semiautomatic switching from bagmaking and packaging using the second film F2 of the second film roll FR2 to bagmaking and packaging using the first film F1 of the first film roll FR1 will now be described with reference to FIG. 5B and FIG. 5C.

(4-1) Switching From Bagmaking and Packaging Using First Film to Bagmaking and Packaging Using Second Film When bagmaking and packaging using the first film F1 of the first film roll FR1 is being performed, setting of the second film roll FR2 by the operator is performed. The setting of the second film roll FR2 is manually performed by the operator. The operator inserts the second retention unit 82 through a central opening in the second film roll FR2 and thereafter manually pays out the starting end F2T of the second film F2 shown in FIG. 6. Then, the operator passes the starting end F2T of the second film F2 around the roller 92*a*, passes it over the rollers 92*b*, 92*c*, and brings it to the first gripping unit 71 through the space above the rollers 91*b*, 91*a* that are currently conveying the first film F1. Thereafter, as described above, the operator passes the starting end F2T of the second film F2 between the restraining member 71*a* and the base 71*b* and lowers the restraining member 71*a* to thereby cause the first gripping unit 71 to grip the starting end F2T of the second film F2.

Figure 5B:
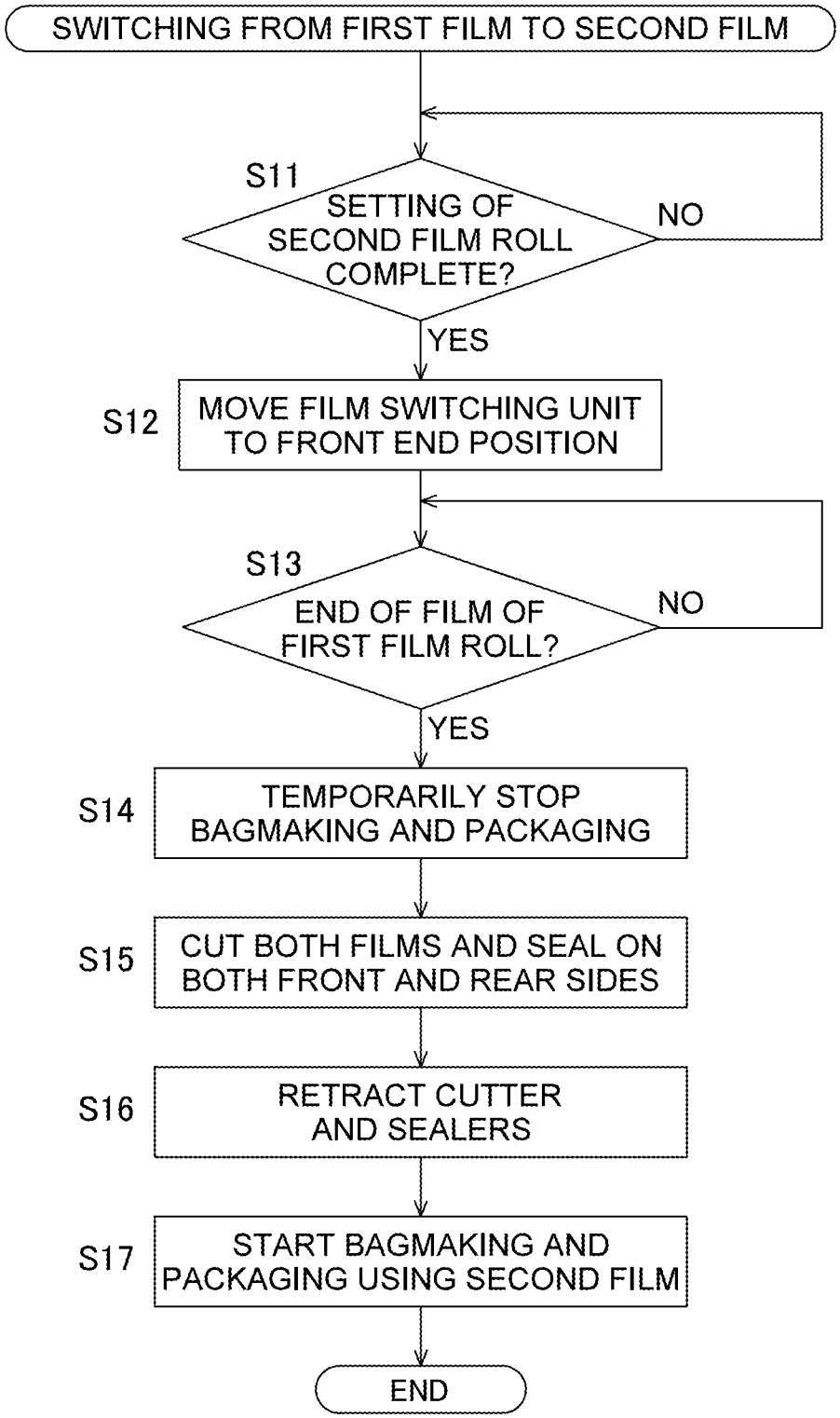
FIG. 5B is a film-switching control flowchart.
Figure 5C:
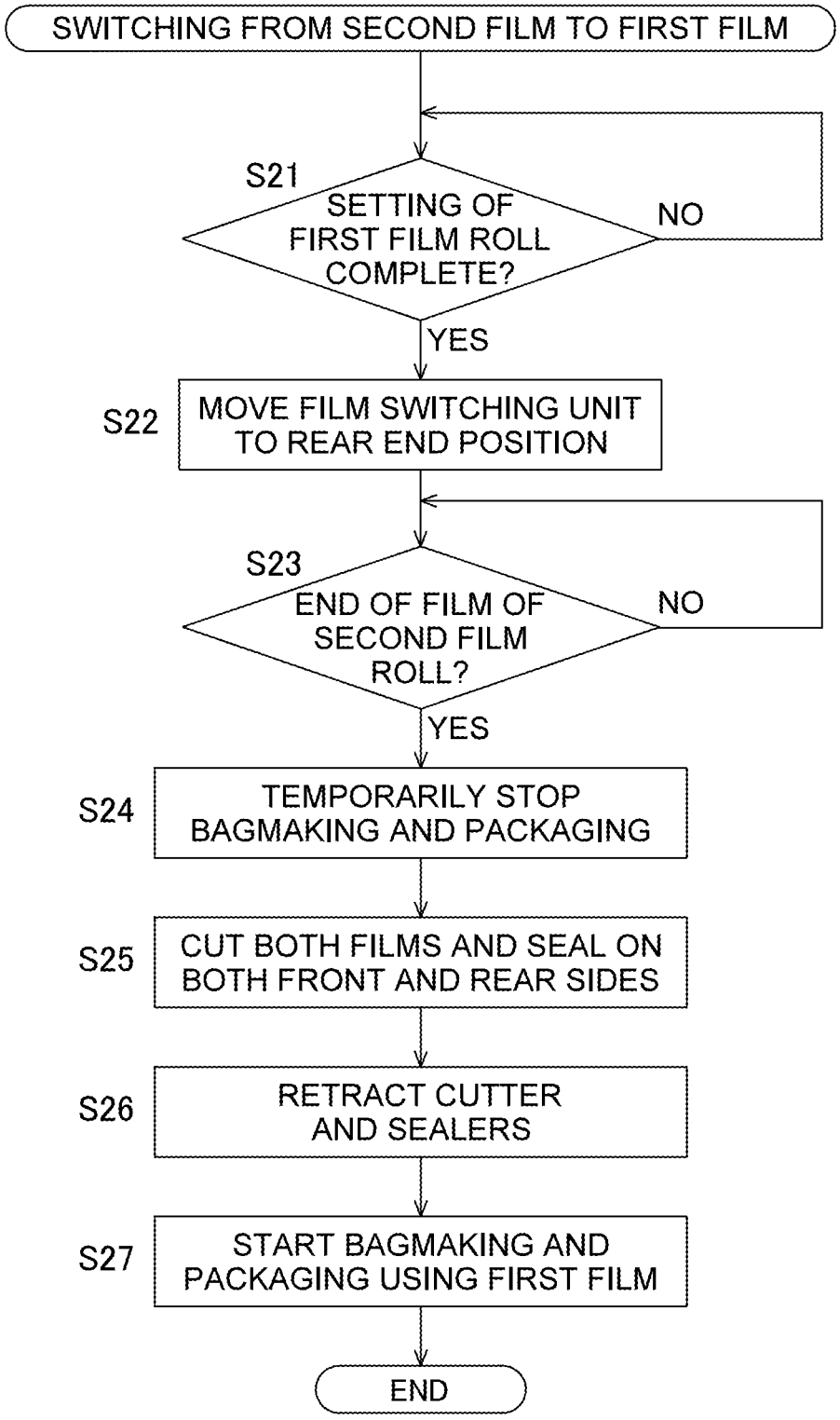
FIG. 5C is a film-switching control flowchart.
Figure 9:
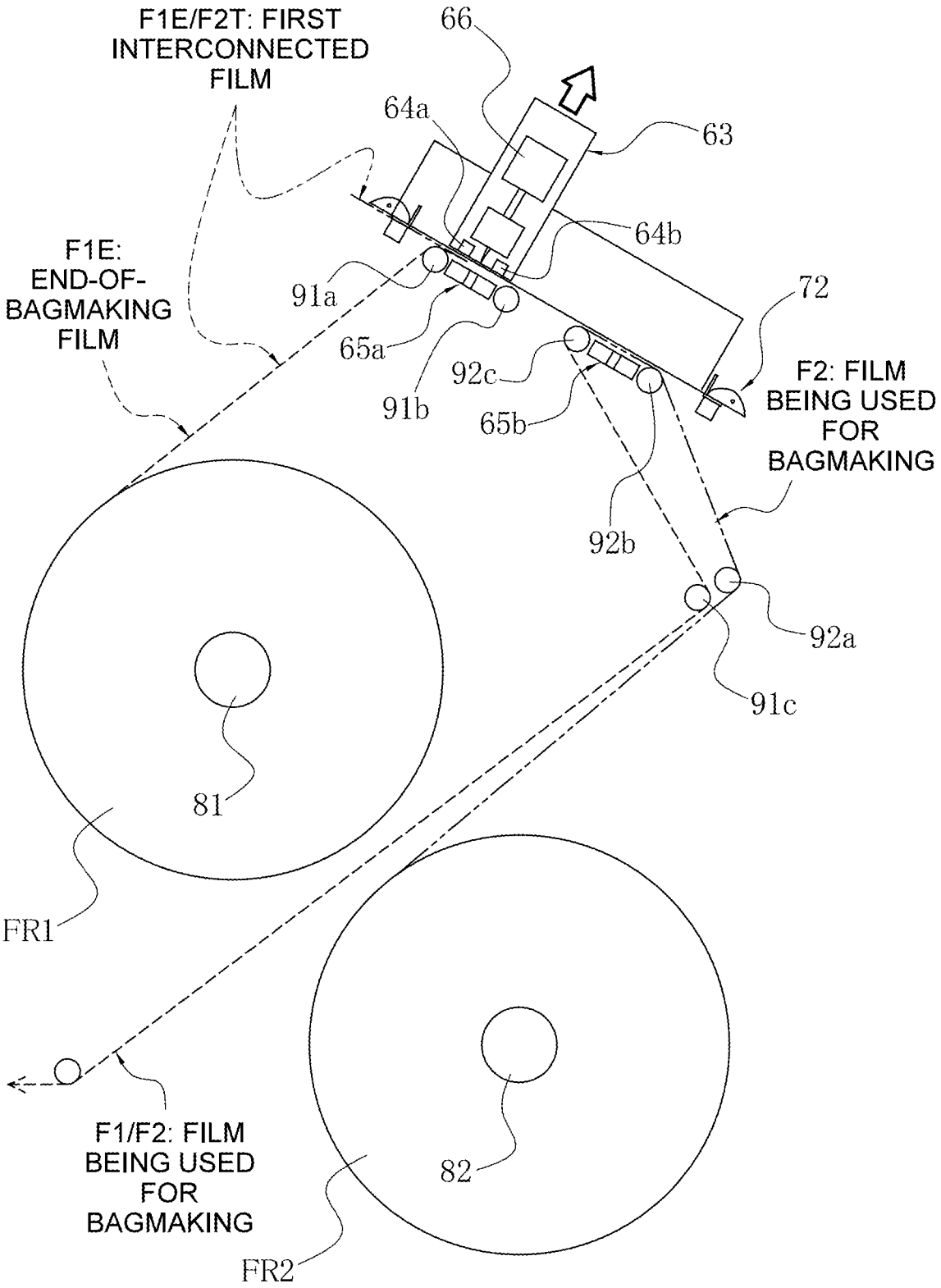
FIG. 9 is a schematic diagram showing a state of the film-supply unit after connecting the second film.
Figure 10:
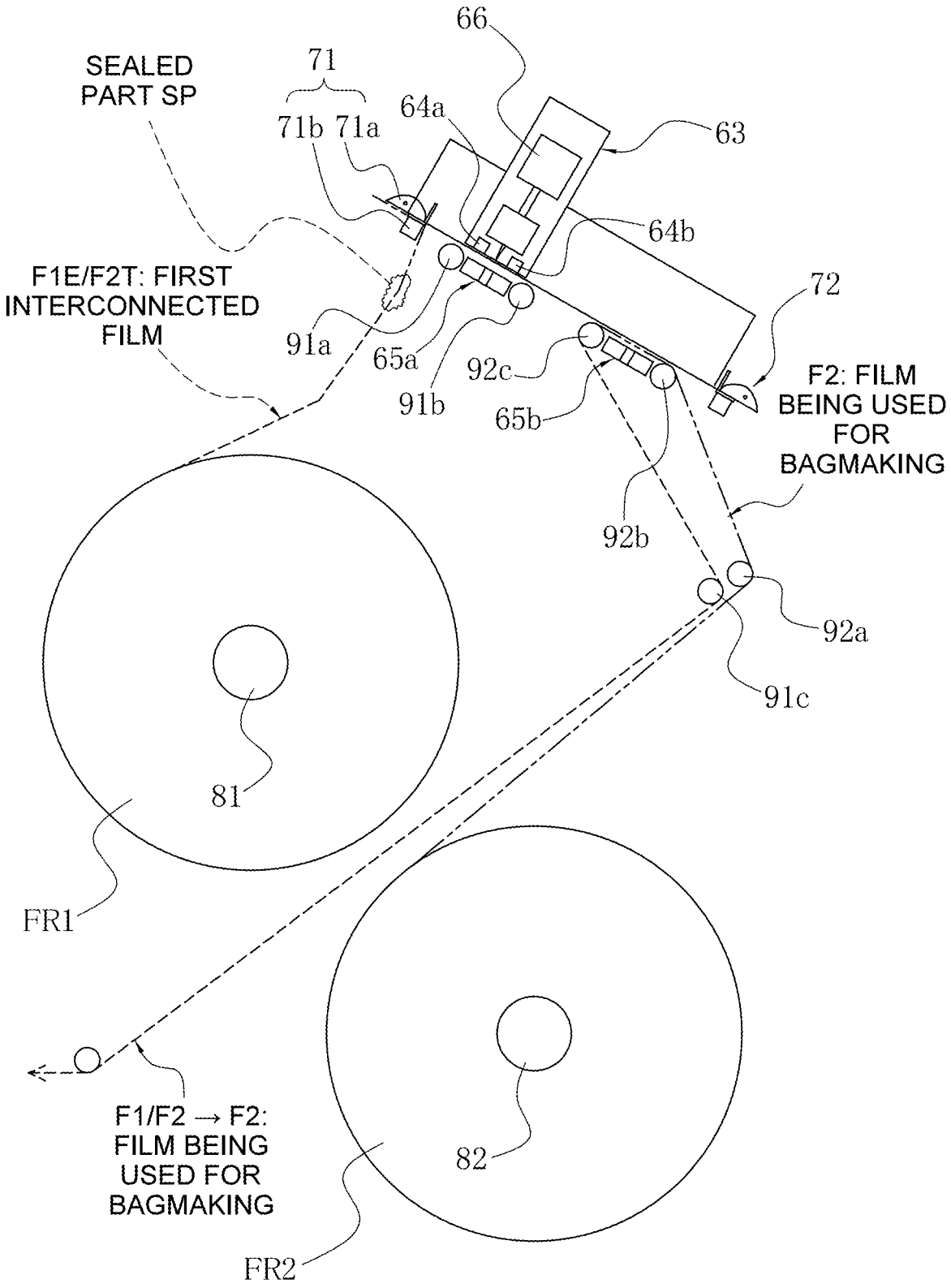
FIG. 10 is a schematic diagram showing a state of the film-supply unit after connecting the second film.
Figure 11:
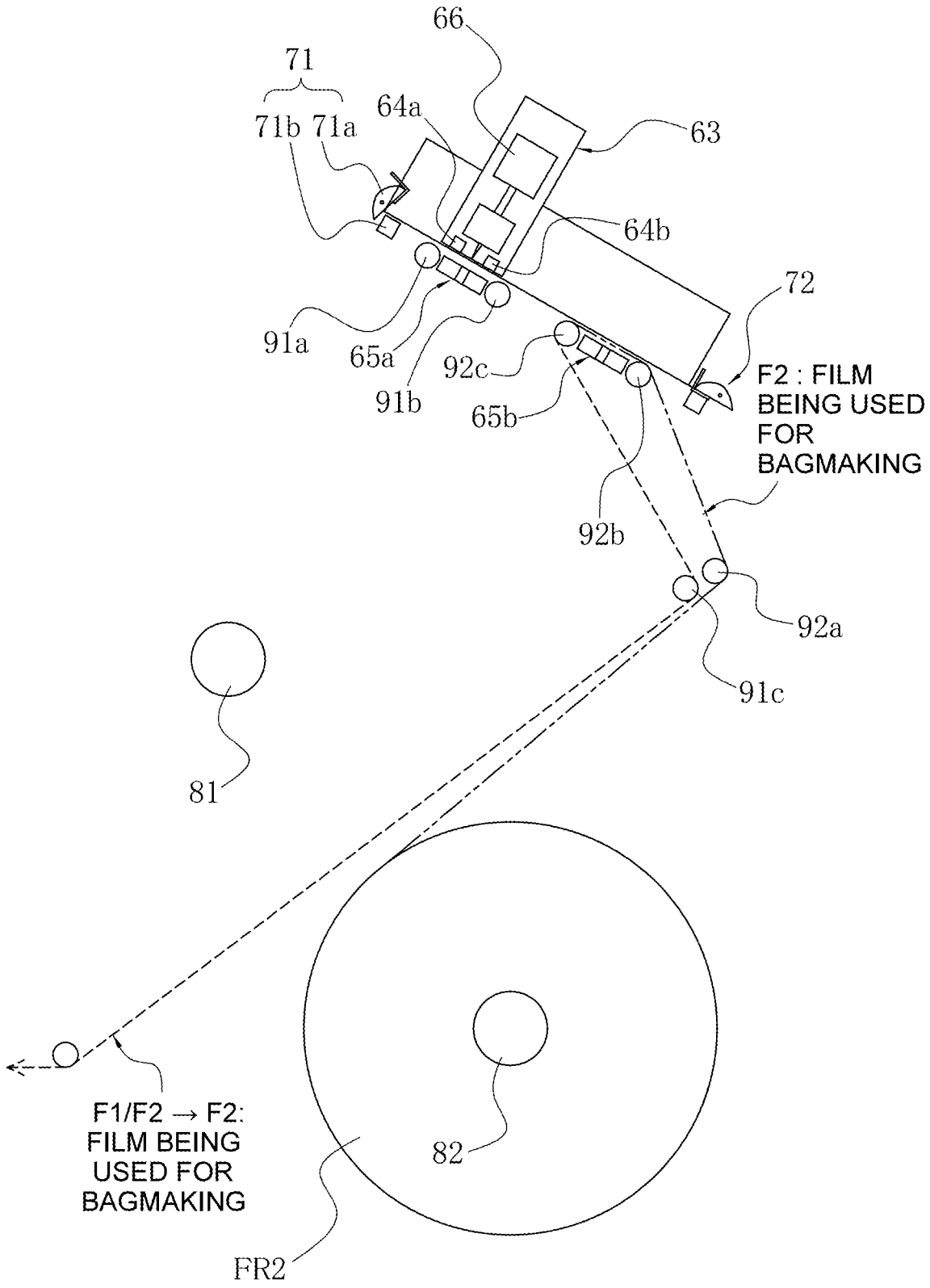
FIG. 11 is a schematic diagram showing a state of the film-supply unit from which a first film roll has been detached.

The control unit 110 determines in step S11 shown in FIG. 5B whether the setting of the second film roll FR2 has been completed. This determination is made based on whether the operator who has finished setting the second film roll FR2 has pushed a "Done" button using the touch panel 111. When the setting of the second film roll FR2 has been completed, in step S12 the control unit 110 moves the film-switching unit 63 from the rear end position shown in FIG. 6 to the front end position shown in FIG. 7. Next, the control unit 110 determines in step S13 whether there is no more of the first film F1 of the first film roll FR1 left. This determination is performed based on detection of the roll drive motor 61 by an encoder. When the control unit 110 determines that there is no more of the first film F1 of the first film roll FR1 left, in step S14 it temporarily stops bagmaking and packaging. Specifically, the control unit 110 stops film conveyance by stopping the roll drive motor 61 and the pull-down belt mechanisms 14 and also stops driving each part of the packaging unit 5. Thereafter, in step S15 the control unit 110 cuts and heat-seals, with the cutter 68 and both impulse sealers 64*a*, 64*b*, the first film F1 and the second film F2 that are stopped in an overlapped state between the roller 91*a* and the roller 91*b*. This cutting and heat-sealing is performed as described above as shown in FIG. 8A and FIG. 8B. Thereafter, as shown in FIG. 9, in step S16 the control unit 110 uses the air cylinder 66 to retract the cutter 68 and both impulse sealers 64*a*, 64*b* to separate the cutter 68 and both impulse sealers 64*a*, 64*b* from the seal table 65*a*. Because of this, as shown in FIG. 10, a heat-sealed part SP in the first interconnected film F1E/F2T comes out from the space between the film-switching unit 63 and the seal table 65*a*. When in step S17 the control unit 110 resumes bagmaking and packaging using the second interconnected film F1/F2 and the trailing second film F2, the operator manually releases the first gripping unit 71 and detaches and removes from the first retention unit 81 the first film roll FR1 that has run out of the first film F1. Because of this, as shown in FIG. 11, there is no longer the first film roll FR1 attached to the first retention unit 81. In the state shown in FIG. 11 also, the control unit 110 continues bagmaking and packaging operations using the second film F2.

(4-2) Switching From Bagmaking and Packaging Using Second Film to Bagmaking and Packaging Using First Film Next, control that comes after step S17 of FIG. 5B will be described with reference to FIG. 5C and FIG. 11 to FIG. 16.

Figure 12:
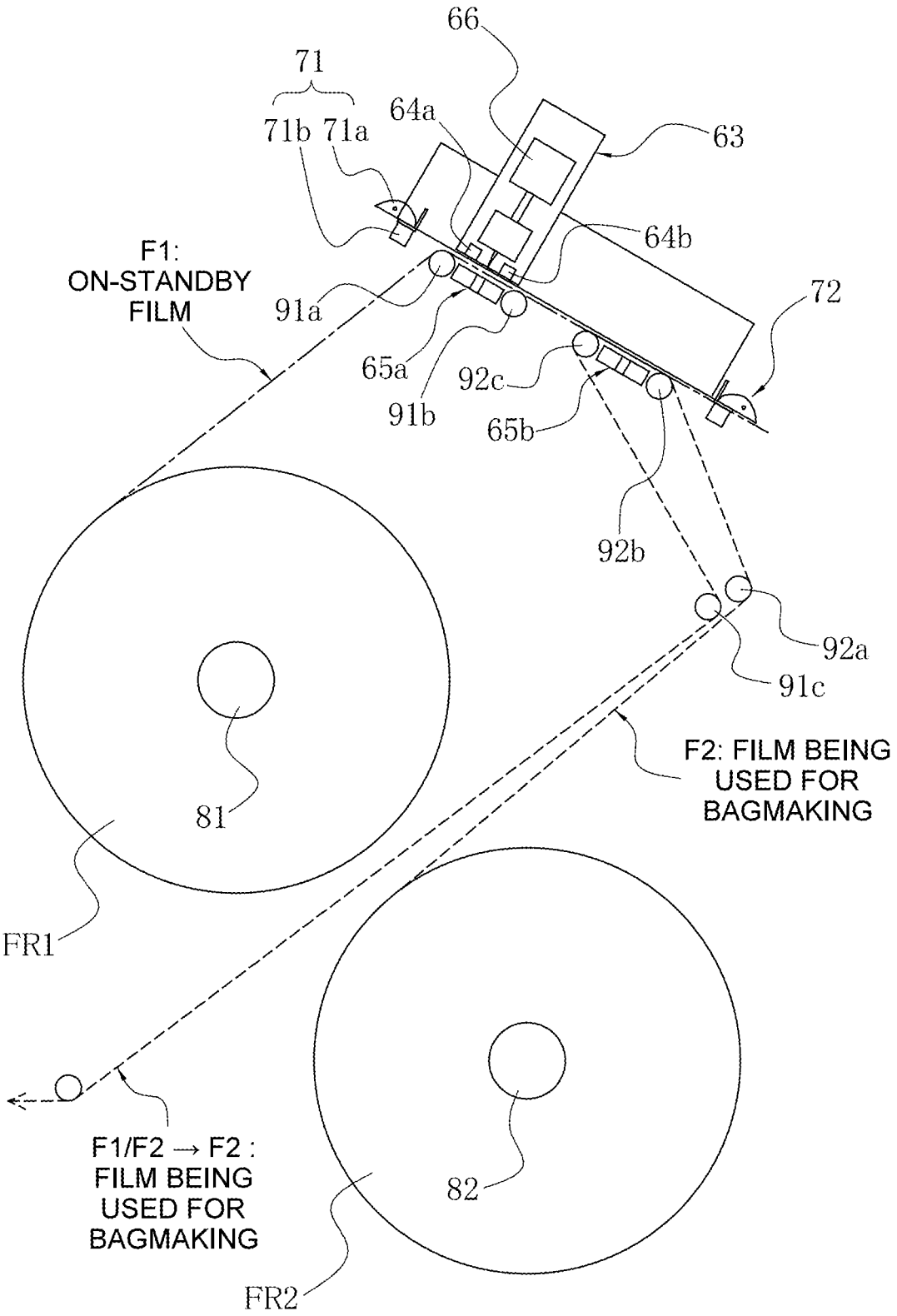
FIG. 12 is a schematic diagram showing a state of the film-supply unit to which the first film roll has been attached.
Figure 15:
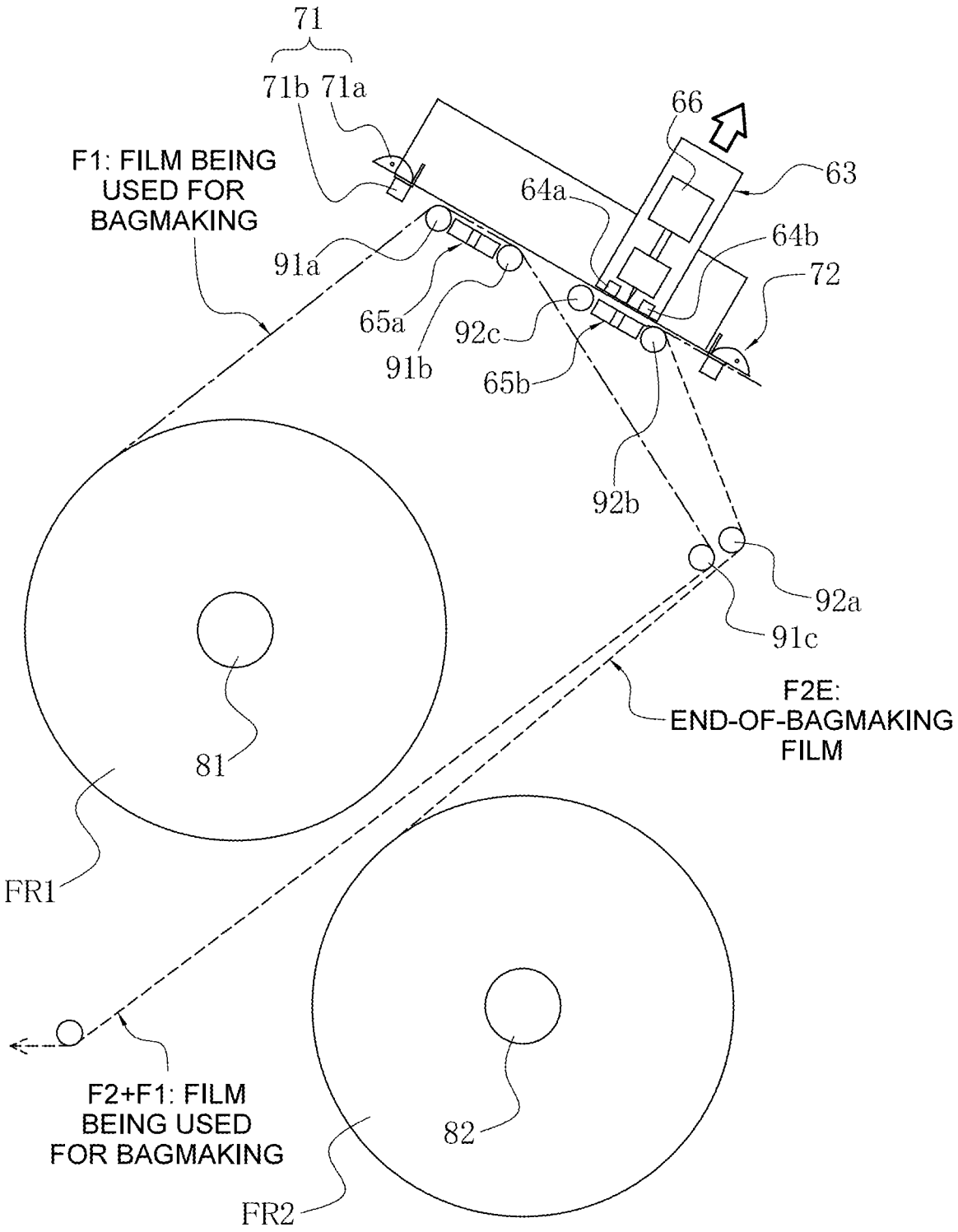
FIG. 15 is a schematic diagram showing a state of the film-supply unit after connecting the first film.
Figure 16:
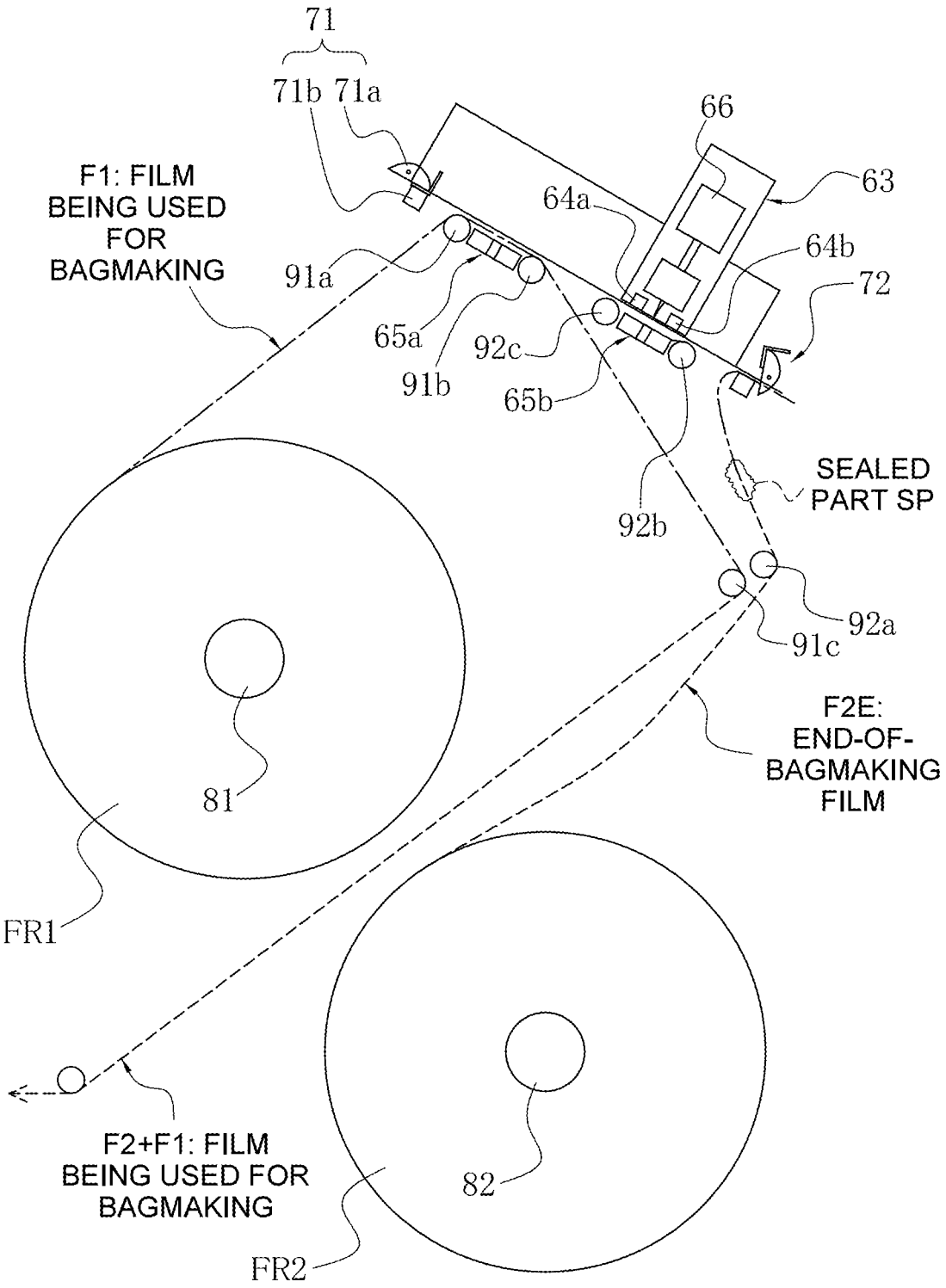
FIG. 16 is a schematic diagram showing a state of the film-supply unit when detaching the second film roll.

The control unit 110 determines in step S21 whether setting of the first film roll FR1 has been completed. When the setting of the first film roll FR1 by the operator from the state shown in FIG. 11 has been completed, as shown in FIG. 12 the starting end F1T of the first film F1 becomes gripped by the second gripping unit 72 in a state in which the second film F2 that is currently being conveyed and the first film F1 that is on standby vertically overlap each other above the rollers 92*b*, 92*c*. When the control unit 110 determines that the setting of the first film roll FR1 has been completed, in step S22 it moves the film-switching unit 63 from the front end position shown in FIG. 12 to the rear end position shown in FIG. 13. Next, the control unit 110 determines in step S23 whether there is no more of the second film F2 of the second film roll FR2 left. This determination is performed based on detection of the roll drive motor 62 by an encoder. When the control unit 110 determines that there is no more of the second film F2 of the second film roll FR2 left, in step S24 it temporarily stops bagmaking and packaging. Thereafter, in step S25 the control unit 110 cuts and heat-seals, with the cutter 68 and both impulse sealers 64*a*, 64*b*, the second film F2 and the first film F1 that are stopped in an overlapped state between the roller 92*b* and the roller 92*c* (see FIG. 14). Thereafter, as shown in FIG. 15, in step S26 the control unit 110 uses the air cylinder 66 to retract the cutter 68 and both impulse sealers 64*a*, 64*b* to separate the cutter 68 and both impulse sealers 64*a*, 64*b* from the seal table 65*b*. Because of this, as shown in FIG. 16, the heat-sealed part SP comes out from the space between the film-switching unit 63 and the seal table 65*b*. When in step S27 the control unit 110 resumes bagmaking and packaging using the interconnected film F2/F1 and the trailing first film F1, the operator manually detaches and removes from the second retention unit 82 the second film roll FR2 that has run out of the second film F2.

(5) CHARACTERISTICS OF BAGMAKING-AND-PACKAGING APPARATUS

5-1

In the bagmaking-and-packaging apparatus 102, as described in sections (2-2-3) and (4-1) above, when switching from bagmaking and packaging using the first film F1 to bagmaking and packaging using the second film F2, the film-switching unit 63 forms the second interconnected film F1/F2 that becomes used for bagmaking and packaging and interconnects the second part (the starting end scrap F2T of FIG. 8B) on the starting end side of the second film F2 and the first part (the end-of-bagmaking film F1E of FIG. 8B) on the first retention unit 81 side of the first film F1 to form the first interconnected film F1E/F2T. For this reason, the second part on the starting end side of the second film F2 is connected to the first part on the first retention unit 81 side of the first film F1 without becoming a scrap of the second film F2. Because of this, in the bagmaking-and-packaging apparatus 102, the second part (the starting end scrap F2T of FIG. 8B) on the starting end side of the second film F2 no longer becomes a scrap of the second film F2, and the burden on the operator of having to remove the scrap of the second film F2 by hand is reduced.

This characteristic is also the same when switching from bagmaking and packaging using the second film F2 to bagmaking and packaging using the first film F1.

5-2

The bagmaking-and-packaging apparatus 102 includes the air cylinder 69 that moves the film-switching unit 63, and the control unit 110 moves the film-switching unit 63 when switching from bagmaking and packaging using the first film F1 to bagmaking and packaging using the second film F2. The control unit 110 also moves the film-switching unit 63 when switching from bagmaking and packaging using the second film F2 to bagmaking and packaging using the first film F1. Because of this, work when replacing by hand the first film roll FR1 or the second film roll FR2 that has run out of film with a new one becomes easier.

5-3

In the bagmaking-and-packaging apparatus 102, the control unit 110 controls the air cylinder 69 so that the position of the film-switching unit 63 when switching from bagmaking and packaging using the first film F1 to bagmaking and packaging using the second film F2 and the position of the film-switching unit 63 when switching from bagmaking and packaging using the second film F2 to bagmaking and packaging using the first film F1 are different. Because of this, work when replacing by hand the first film roll FR1 or the second film roll FR2 that has run out of film with a new one becomes simple.

(6) EXAMPLE MODIFICATIONS

6-1

Although in the above embodiment the air cylinders 66, 69 are employed, electric actuators, such as electric ball screw mechanisms, or hydraulic actuators may be used instead of these.

Furthermore, instead of the impulse sealers 64*a*, 64*b*, other sealers such as hot plate sealers, ultrasonic sealers, and high-frequency sealers may be employed.

6-2

Although in the above embodiment no distinction is made between the front sides and the back sides of the first film F1 and the second film F2, depending on the material of the films there are cases where the temperature of the sealers suited for heat-sealing differs between the front sides and the back sides. In such cases, the control unit 110 may be configured to change the output of the impulse sealers 64*a*, 64*b* based on film information such as the winding direction (front side facing out, back side facing out) of the film F1 (F2) and whether the films are for being overlapped or for being pinch-sealed. Because of this, the impulse sealers 64*a*, 64*b* are adjusted to appropriate sealing temperatures and appropriate sealing durations.

For example, the control unit 110 changes the duration of the heat-sealing of the first film F1 and the second film F2 depending on whether contact surfaces of the first film F1 and the second film F2 that overlap each other are front sides of the films or back sides of the films.

6-3

In the above embodiment, after bagmaking and packaging is resumed using the new second film F2, the operator manually releases the first gripping unit 71 and detaches and removes from the first retention unit 81 the first film roll FR1 that has run out of the first film F1. In this case, it is assumed that the operator detaches the first film roll FR1 without moving the first retention unit 81, so that the first interconnected film F1E/F2T including the second part (the starting end scrap F2T) on the starting end side of the second film F2 comes out of the bagmaking-and-packaging apparatus 102 with the first film roll FR1.

Instead of this, the control unit 110 may automatically perform, or the operator may perform, a predetermined operation so that the first retention unit 81 is rotated just a little by the roll drive motor 61 to take up the first interconnected film F1E/F2T on the first film roll FR1.

6-4

Although in the above embodiment the claimed invention was described using as an example the bagmaking-and-packaging apparatus 102 that uses the film-supply unit 6 including the two impulse sealers 64*a*, 64*b* to interconnect the first film F1 and the second film F2, specific examples of the claimed invention are not limited to the above embodiment. For example, a bagmaking-and-packaging apparatus that uses a film-supply unit 106 shown in FIG. 17 to FIG. 22 to interconnect a first film F101 and a second film F102 is also a specific example of the claimed invention. The film-supply unit 106 will be described below focusing on parts that are different from the film-supply unit 6 described above.

The film-supply unit 106 has a first retention unit that retains a first film roll FR101, a second retention unit that retains a second film roll FR102, a conveyance unit that includes plural rollers 190 and a film conveyance mechanism, one pair of a sealer 164 and a table 165, and a cutter 168. The conveyance unit conveys the first film F101 and the second film F102 in a film conveyance direction. The sealer 164 extends in a direction orthogonal to the film conveyance direction. Regarding the plural rollers 190, illustration of rollers not necessary for the following description of operations is omitted.

Figure 17:
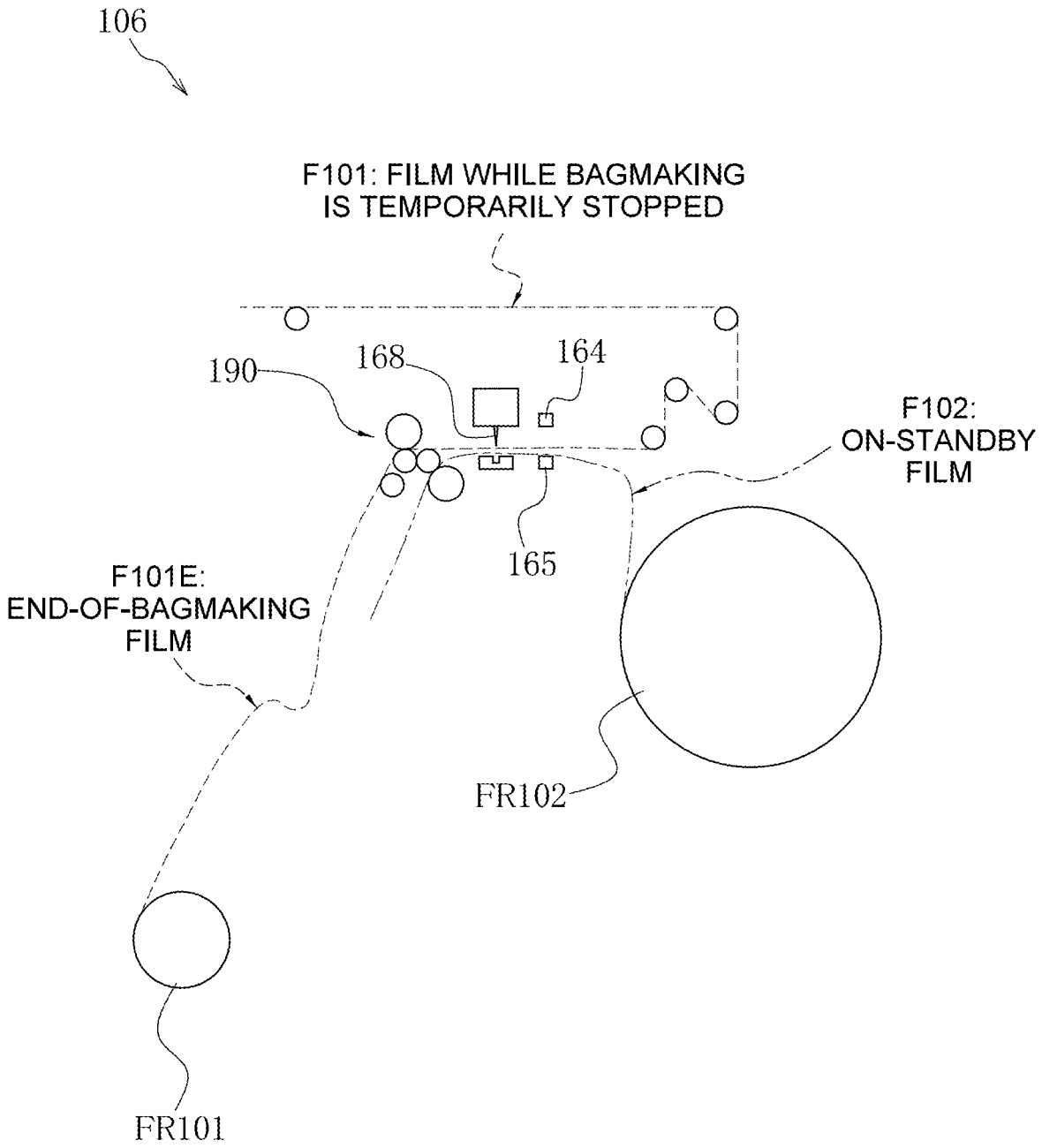
FIG. 17 is a schematic diagram showing a state of a film-supply unit of an example modification before connecting a second film.
Figure 18:
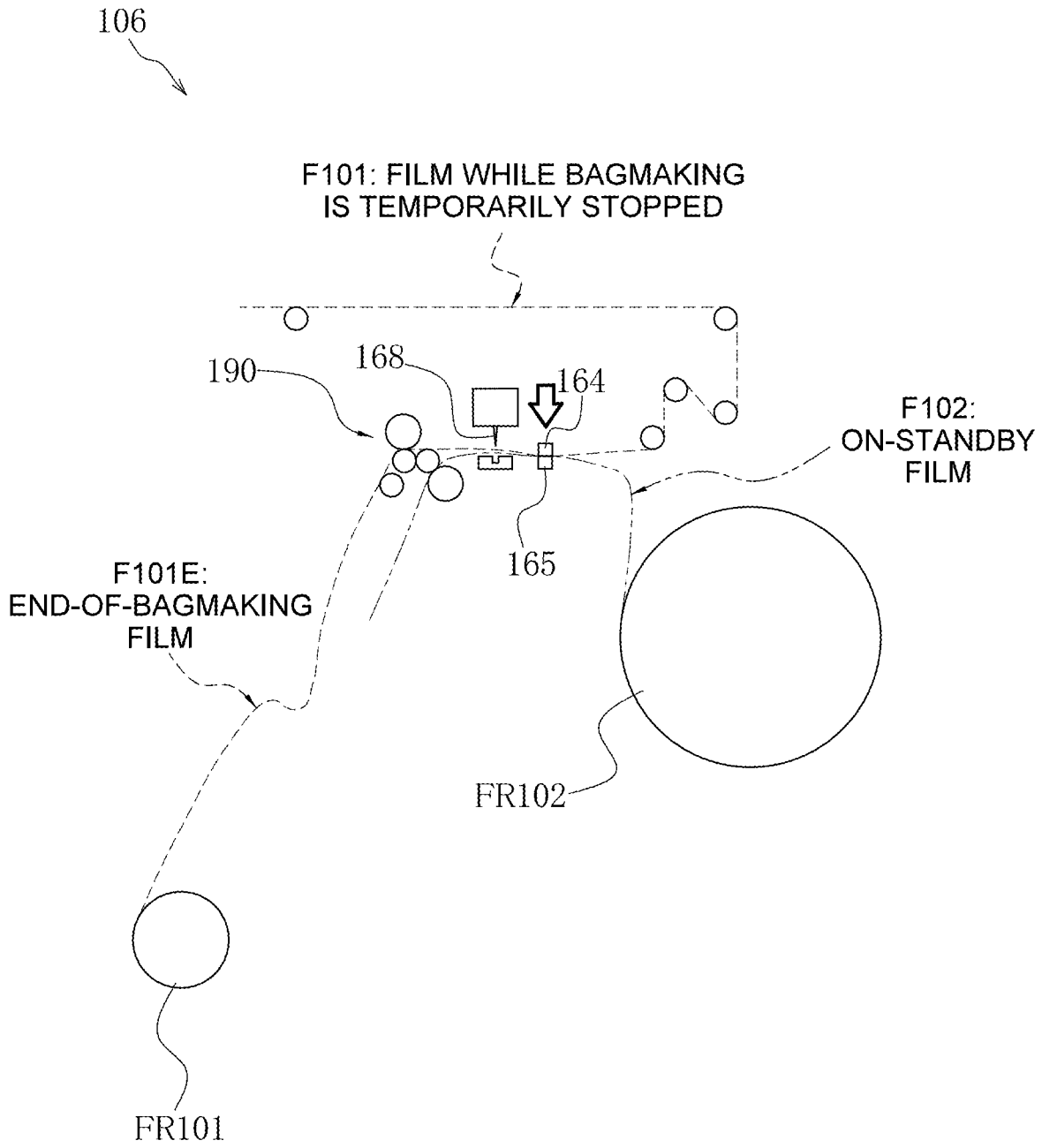
FIG. 18 is a schematic diagram showing a state of the film-supply unit of the example modification when connecting the second film.
Figure 19:
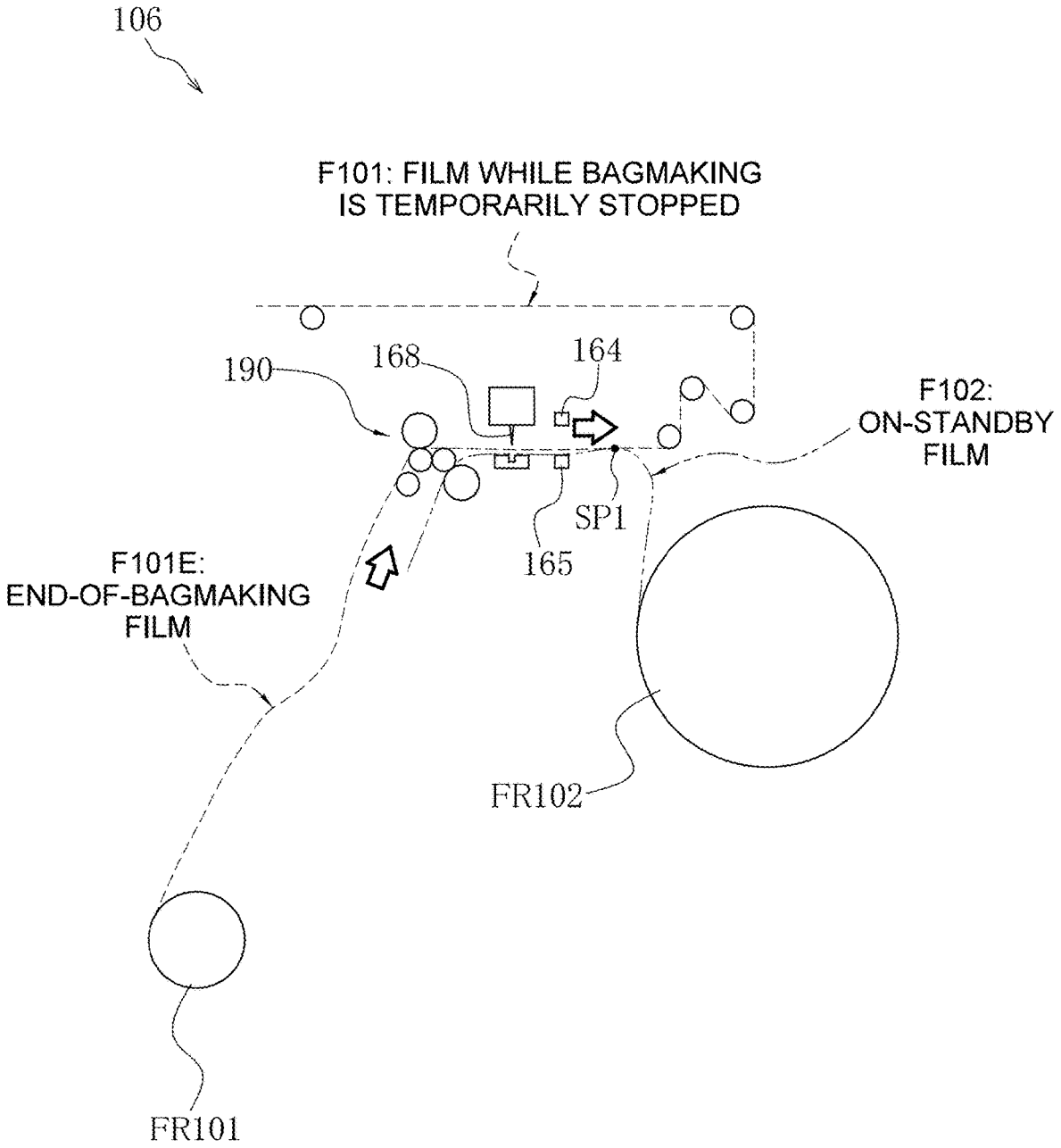
FIG. 19 is a schematic diagram showing a state of the film-supply unit of the example modification after connecting the second film.
Figure 20:
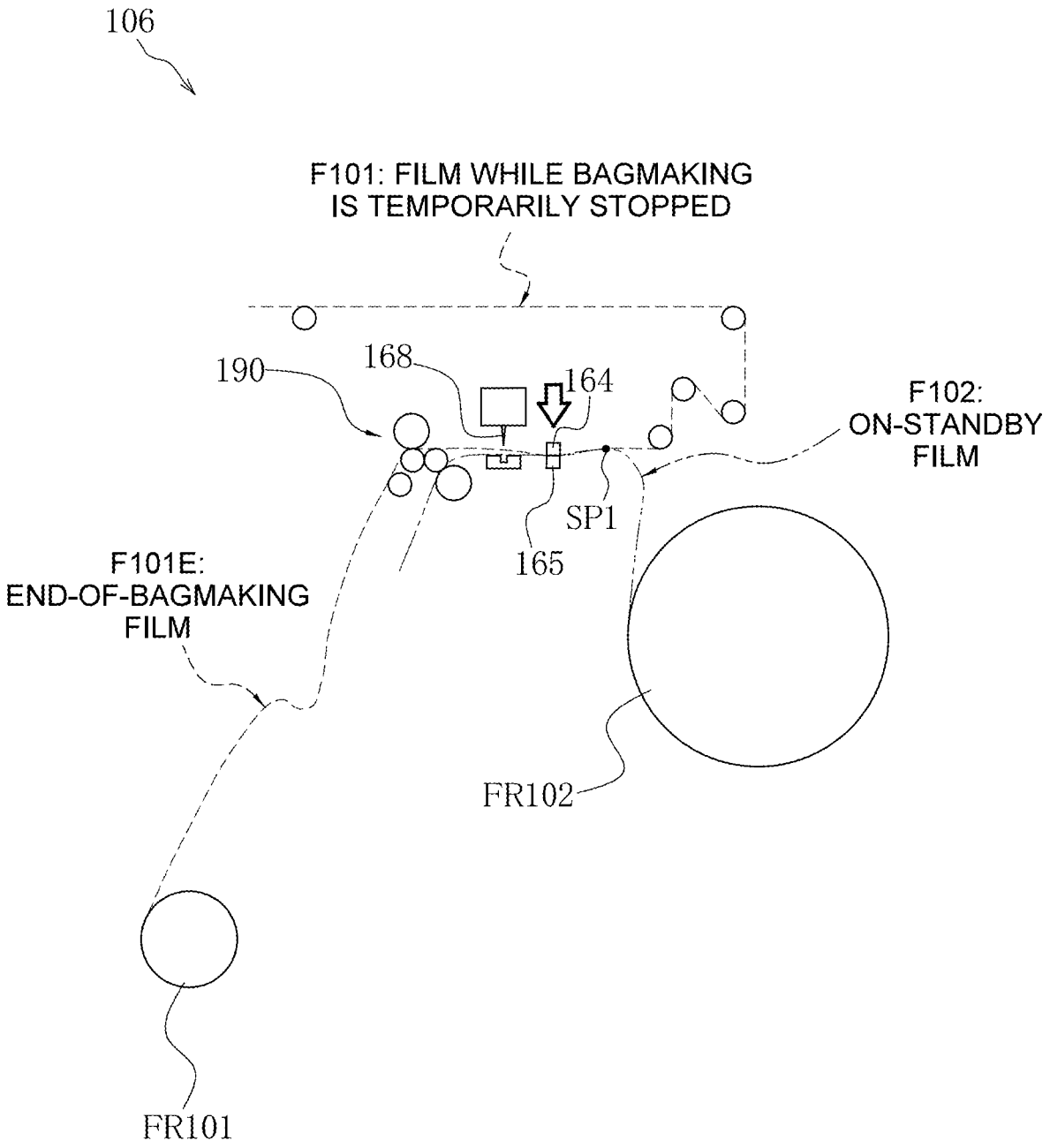
FIG. 20 is a schematic diagram showing a state of the film-supply unit of the example modification after connecting the second film.
Figure 21:
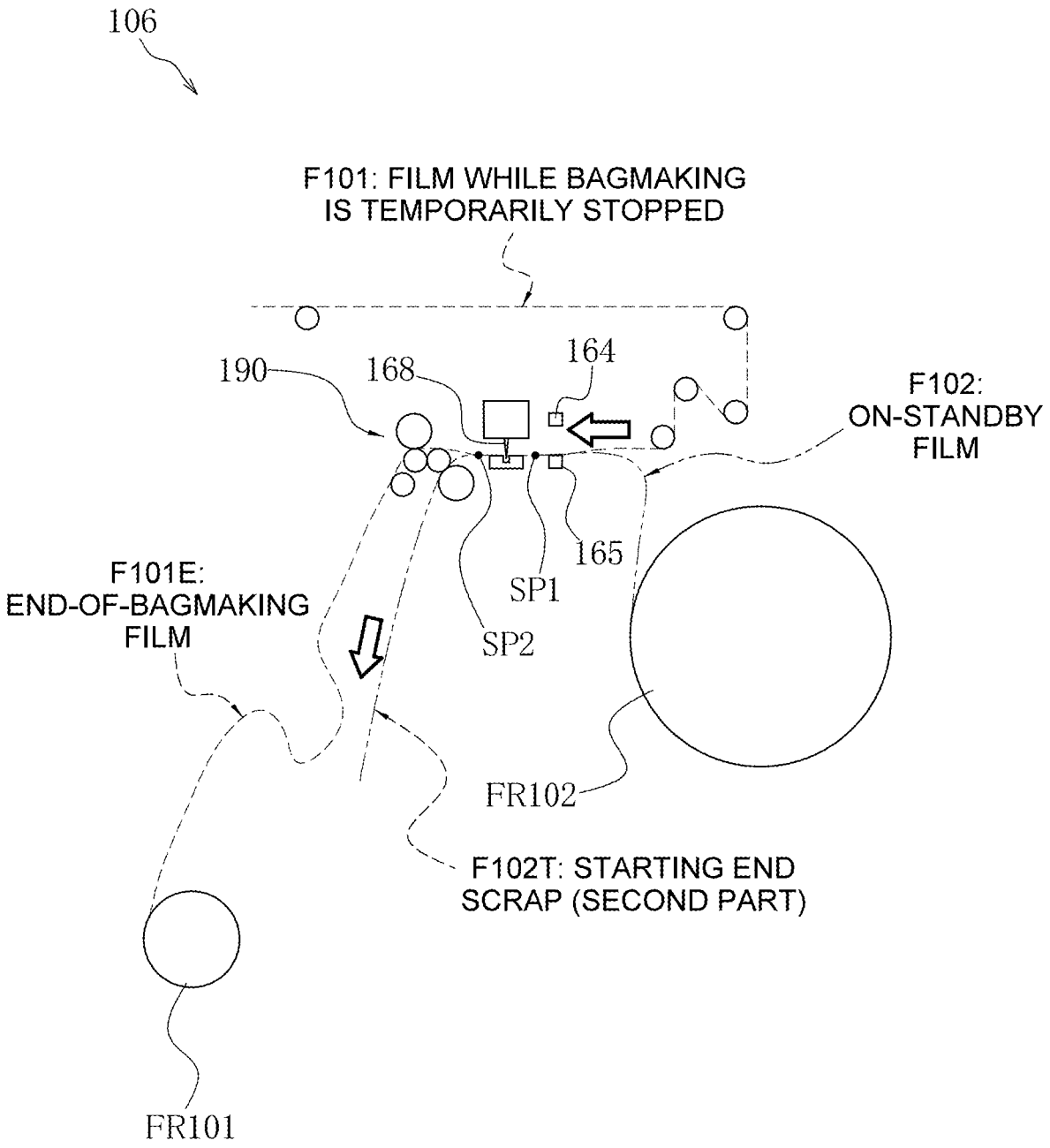
FIG. 21 is a schematic diagram showing a state of the film-supply unit of the example modification after connecting the second film.
Figure 22:
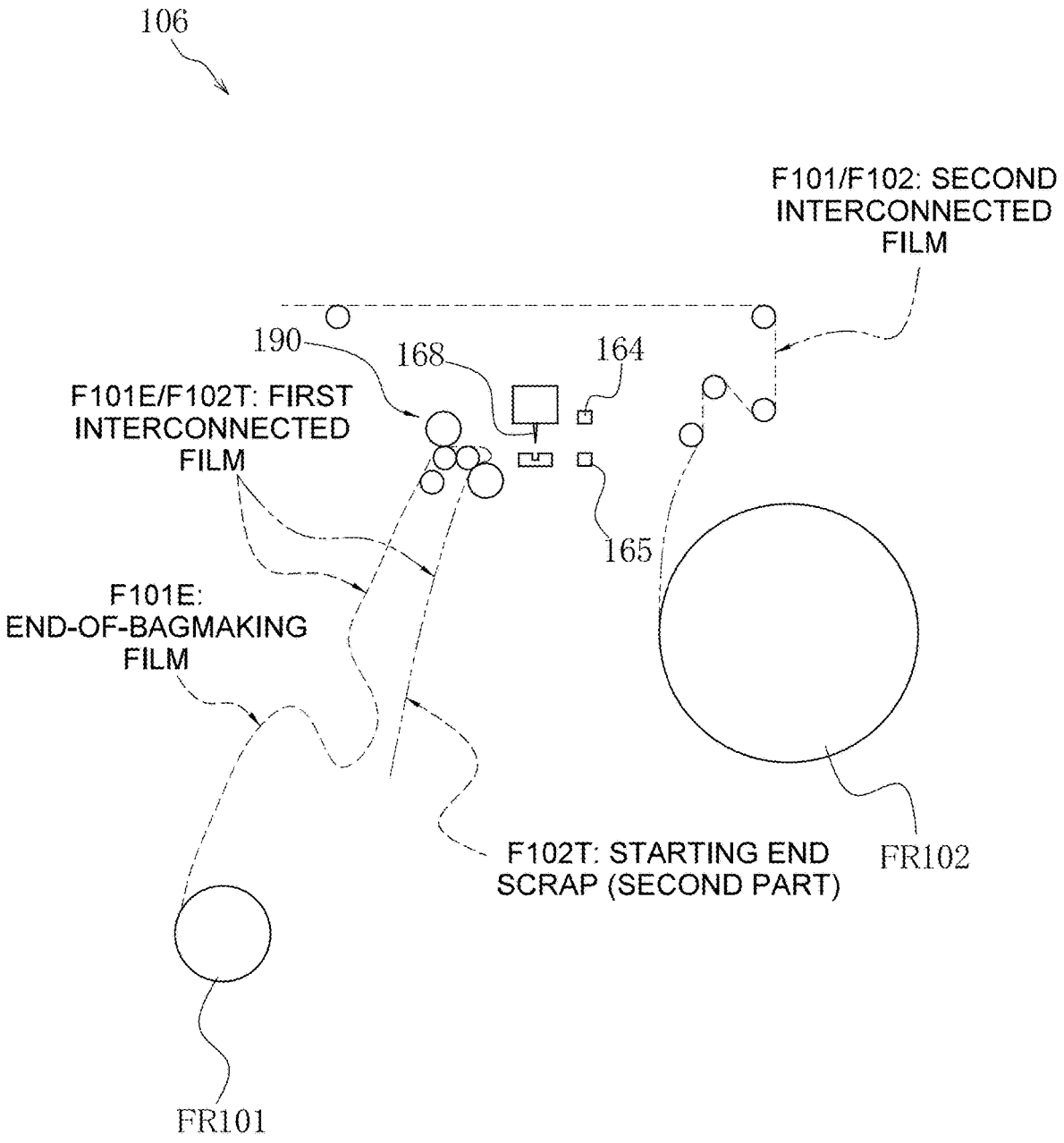
FIG. 22 is a schematic diagram showing a state of the film-supply unit of the example modification after connecting the second film.

As shown in FIG. 17, when there is no more of the film of the first film roll FR101 left, bagmaking is temporarily stopped, and the first film F101 and the second film F102 vertically overlap each other in a stopped state below the sealer 164. In this state, as shown in FIG. 18, the sealer 64 descends and the first film F101 and the second film F102 are partially heat-sealed (interconnected). Thereafter, the conveyance unit conveys the first film F101 and the second film F102 in a forward direction as shown in FIG. 19 so that an interconnected point SP1 formed by the sealer 164 moves rightward in the drawing. In this state, as shown in FIG. 20, the sealer 164 again descends and the first film F101 and the second film F102 are heat-sealed. This interconnected point SP2, as shown in FIG. 21, moves leftward in the drawing beyond the space under the cutter 168 as a result of the conveyance unit thereafter conveying the first film F101 and the second film F102 in the opposite direction. When the conveyance of the first film F101 and the second film F102 in the opposite direction by the conveyance unit ends, the first interconnected point SP1 (first position) becomes positioned on the right side of the cutter 168 and the second interconnected point SP2 (second position) becomes positioned on the left side of the cutter 168. Then, as shown in FIG. 22, when the cutter 168 descends, the first film F101 and the second film F102 are cut in a position between the first interconnected point SP1 and the second interconnected point SP2. That is, the cutter 168 functioning as a cutting unit cuts the first film F101 and the second film F102 in a position between the first position and the second position. Because of this, in the bagmaking-and-packaging apparatus of this example modification, when switching from bagmaking using the first film F101 to bagmaking using the second film F102, as shown in FIG. 22, a first interconnected film F101E/F102T is formed and a second interconnected film F101/F102 is formed. Specifically, the sealer 164 of the bagmaking-and-packaging apparatus interconnects a first part F101E on the first retention unit side of the first film F101 and a second part F102T on the starting end side of the second film F102 to form a first interconnected film F101E/F102T that is a film in which the first part F101E and the second part F102T are interconnected. Furthermore, the sealer 164 of the bagmaking-and-packaging apparatus interconnects a third part on the starting end side of the first film F101 and a fourth part on the second retention unit side of the second film F102 to form a second interconnected film F101/F102 that is a film in which the third part and the fourth part are interconnected.

REFERENCE SIGNS LIST

5 Packaging Unit (Bagmaking-and-packaging unit)
14 Pull-down Belt Mechanisms (Conveyance Unit)
61 Roll Drive Motor (Conveyance Unit)
62 Roll Drive Motor (Conveyance Unit)
63 Film-switching Unit
64*a* First Impulse Sealer (First Sealing Unit; Interconnecting Unit; Splicing Unit)
64*b* Second Impulse Sealer (Second Sealing Unit; Interconnecting Unit; Splicing Unit)
68 Cutter (Cutting Unit)
69 Air Cylinder (Moving Unit)
81 First Film Roll Retention Unit (First Retention Unit)
82 Second Film Roll Retention Unit (Second Retention Unit)
91*a* to 91*c* Rollers (Conveyance Unit)
92*a* to 92*c* Rollers (Conveyance Unit)
93*a* to 93*o* Rollers (Conveyance Unit)
100 Weighing, Bagmaking, and Packaging System
102 Bagmaking-and-packaging apparatus
110 Control Unit
164 Sealer (Interconnecting Unit; Splicing Unit)
168 Cutter (Cutting Unit)
F1, F101 First Films
F2, F102 Second Films
FR1, FR101 First Film Rolls
FR2, FR102 Second Film Rolls
F1E/F2T, F101E/F102T First Interconnected Films
F1/F2, F101/F102 Second Interconnected Films

What is claimed is:

1. A bagmaking-and-packaging apparatus, comprising:

a first retention unit that retains a first film roll in which a film is wound;

a second retention unit that retains a second film roll in which a film is wound;

a conveyance unit that conveys a film in a film conveyance direction;

a bagmaking-and-packaging unit that makes bags containing articles using the film conveyed by the conveyance unit;

an interconnecting unit that has a splicing unit extending in a direction intersecting the film conveyance direction and that uses the splicing unit to interconnect a first film, which is the film from the first film roll, and a second film, which is the film from the second film roll, in a first position and a second position where the first film and the second film overlap each other;

a control unit that controls the interconnecting unit, wherein:

the splicing unit heat-seals the first film and the second film, and the control unit changes a duration of the heat-sealing of the first film and the second film depending on whether contact surfaces of the first film and the second film that overlap each other are front sides of the films or back sides of the films; and a cutting unit that cuts the first film and the second film in a position between the first position and the second position, wherein when switching from bagmaking using the first film to bagmaking using the second film, the splicing unit:

interconnects a first part on a first retention unit side of the first film and a second part on a starting end side of the second film to form a first interconnected film that is a film in which the first part and the second part are interconnected, and interconnects a third part on a starting end side of the first film and a fourth part on a second retention unit side of the second film to form a second interconnected film that is a film in which the third part and the fourth part are interconnected.

2. The bagmaking-and-packaging apparatus of claim 1, wherein;

the splicing unit has a first sealing unit and a second sealing unit that each extend in a direction intersecting the film conveyance direction and that are disposed a predetermined distance apart from each other in the film conveyance direction, the first sealing unit interconnects the first film and the second film in the first position, the second sealing unit interconnects the first film and the second film in the second position, and when switching from bagmaking using the first film to bagmaking using the second film, the first sealing unit interconnects the first part and the second part to form the first interconnected film and the second sealing unit interconnects the third part and the fourth part to form the second interconnected film.

3. The bagmaking-and-packaging apparatus of claim 1, wherein the cutting unit cuts the first film between the first part and the third part and the second film between the second part and the fourth part.

4. The bagmaking-and-packaging apparatus of claim 3, wherein the apparatus switches from bagmaking using the first film to bagmaking using the second interconnected film and furthermore switches from bagmaking using the second interconnected film to bagmaking using the second film after the formation of the first interconnected film, the formation of the second interconnected film, and the cutting of the first film and the second film.

5. The bagmaking-and-packaging apparatus of claim 2, further comprising a moving unit that moves the interconnecting unit, wherein the moving unit moves the interconnecting unit when switching from bagmaking using the first film to bagmaking using the second film.

6. The bagmaking-and-packaging apparatus of claim 5, wherein the control unit controls the moving unit, and wherein the control unit controls the moving unit so that a position of the interconnecting unit when switching from bagmaking using the first film to bagmaking using the second film and a position of the interconnecting unit when switching from bagmaking using the second film to bagmaking using the first film are different.

7. The bagmaking-and-packaging apparatus of claim 1, wherein the conveyance unit conveys the first film and the second film after the interconnection of the first film and the second film by the splicing unit in the first position and before the interconnection of the first film and the second film by the splicing unit in the second position.

8. The bagmaking-and-packaging apparatus of claim 7, wherein the cutting unit cuts the first film and the second film in a position between the first position and the second position after the interconnection of the first film and the second film by the splicing unit in the second position.

9. The bagmaking-and-packaging apparatus of claim 8, wherein the conveyance unit conveys the first film and the second film to the position in which the first film and the second film are to be cut by the cutting unit after the interconnection of the first film and the second film by the splicing unit in the second position and before cutting of the first film and the second film by the cutting unit.

* * * * *